US010156811B2

(12) United States Patent
Hamada et al.

(10) Patent No.: US 10,156,811 B2
(45) Date of Patent: Dec. 18, 2018

(54) CONVEYING DEVICE HAVING A FIRST CONVEYANCE MEMBER THAT TRANSMITS DRIVING FORCE TO A SECOND CONVEYANCE MEMBER

(71) Applicant: CANON KABUSHIKI KAISHA, Tokyo (JP)

(72) Inventors: Takatoshi Hamada, Mishima (JP); Takuya Kawakami, Mishima (JP); Go Torii, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/946,600

(22) Filed: Nov. 19, 2015

(65) Prior Publication Data

US 2016/0154341 A1 Jun. 2, 2016

(30) Foreign Application Priority Data

Nov. 28, 2014 (JP) ..... 2014-242589
Nov. 11, 2015 (JP) ..... 2015-221356

(51) Int. Cl.
*G03G 21/12* (2006.01)
*G03G 15/08* (2006.01)
*G03G 21/10* (2006.01)

(52) U.S. Cl.
CPC ..... *G03G 15/0891* (2013.01); *G03G 21/105* (2013.01)

(58) Field of Classification Search
CPC ..... G03G 15/0891; G03G 21/105
USPC ..... 399/358
See application file for complete search history.

(56) References Cited

U.S. PATENT DOCUMENTS 8,185,007 B2 5/2012 Tsukamura
2007/0242993 A1* 10/2007 Tanaka ..... G03G 15/0865 399/358
2008/0124103 A1 5/2008 Uchida
2010/0046999 A1* 2/2010 Lee ..... G03G 15/161 399/358
2014/0186071 A1 7/2014 Sato

FOREIGN PATENT DOCUMENTS

JP H09-319222 A 12/1997
JP 2002-072811 A 3/2002
JP 2006133465 A 5/2006
JP 3851530 B2 * 11/2006
JP 2008-096593 A 4/2008
JP 2013-122537 A 6/2013
RU 2410738 C1 1/2011

OTHER PUBLICATIONS

Hayakawa. Machine Translation of JP 3851530 B2. Published Nov. 2006. Translated Jan. 2018.*

* cited by examiner

*Primary Examiner* — Walter L Lindsay, Jr.
*Assistant Examiner* — Philip Marcus T Fadul
(74) *Attorney, Agent, or Firm* — Canon U.S.A., Inc. IP Division

(57) ABSTRACT

A conveying device in which a circle formed of a trajectory drawn by a distal end of an engaging portion and an axial line of a driven shaft intersect each other when viewing in an axial direction of a drive shaft, and a slope of the driven shaft with respect to a horizontal direction is an angle not larger than an angle of repose of a developer when viewing in the axial direction of the drive shaft is provided.

17 Claims, 23 Drawing Sheets

CONVEYING DEVICE HAVING A FIRST CONVEYANCE MEMBER THAT TRANSMITS DRIVING FORCE TO A SECOND CONVEYANCE MEMBER

BACKGROUND OF THE INVENTION

Field of the Invention

The present invention relates to a conveying device configured to convey a developer, and more particularly, to a process cartridge and an image forming apparatus having such a conveying device.

The term "process cartridge" corresponds to a member including at least an image bearing member. For example, a process cartridge having an electrophotographic image forming system includes an electrophotographic photosensitive drum, which corresponds to the image bearing member, and a process device, which acts on the electrophotographic photosensitive drum. The electrophotographic photosensitive drum and the process device are integrated into a cartridge. The process cartridge described above is configured to be detachably attached to a main body of an electrophotographic image forming apparatus. Examples of the process device include a cartridge having at least one of a developing device, a charging device, and a cleaning device integrated therein.

The electrophotographic image forming apparatus is configured to form an image on a recording material by using the electrophotographic image forming system.

Examples of the electrophotographic image forming apparatus include, for example, electrophotographic copying machines, electrophotographic printers (LED printers, laser beam printers) facsimile machines, and word processors.

Description of the Related Art

An electrophotographic image forming apparatus (hereinafter, also referred to simply as "image forming apparatus") is configured to form an image by uniformly charging a drum-shaped photosensitive member, which corresponds to an image bearing member, selectively exposing the charged photosensitive drum to form an electrostatic latent image (an electrostatic image) on the photosensitive drum, developing the electrostatic latent image formed on the photosensitive drum as a developer image (a toner image) by using toner, which corresponds to a developer, transferring the toner image formed on the photosensitive drum to a recording material such as a recording sheet and a plastic sheet, and fixing the toner image transferred to the recording material to the recording material by application of heat and pressure, thereby completing image recording.

The image forming apparatus as described above generally requires supplementation of toner and maintenance of various process devices. In order to facilitate supplementation of toner and maintenance, a configuration of a process cartridge including the photosensitive drum, a charging device, and a developing device housed together in a form of a process cartridge, which is detachably attachable with respect to an main body of the image forming apparatus, has already been put to practical use.

According to the process cartridge system described above, since a user can perform maintenance of the apparatus on his/her own, operability is significantly improved. Therefore, an image forming apparatus having superior usability is provided. Therefore, the process cartridge system described above is widely employed in the field of the image forming apparatus.

Some of the process cartridges as described above may need to convey toner to a position at a distance (Japanese Patent Laid-Open No. 2006-133465, Japanese Patent No. 3851530). Japanese Patent Laid-Open No. 2006-133465 discloses a configuration in which two screws are arranged in an overlapped manner to convey the toner to a position at a distance to accommodate a requirement of the toner conveyance. Two such screws arranged in the overlapped manner allow drive transmission and toner delivery to be performed simultaneously.

However, in the configuration having the screws arranged in the overlapped manner as described in Japanese Patent Laid-Open No. 2006-133465, the thickness (height) of a portion of a container that accommodates the screws in an overlapped manner needs to be at least double the thickness (height) of one screw. Therefore, a conveying device configured to convey the developer is increased in the size, and the image forming apparatus may also be increased in the size correspondingly.

SUMMARY OF THE INVENTION

The invention provides a conveying device including: a developer conveying path configured to convey a developer; a first conveyance member having a drive shaft provided with a drive transmission portion configured to transmit a driving force; and a second conveyance member having a driven shaft provided with a driving force receiving portion configured to receive a driving force from the drive transmission portion, wherein the drive transmission portion includes an engaging portion that projects from the drive shaft, the driving force receiving portion includes an engaged portion which is driven by being engaging with the engaging portion in an interior of the developer conveying path, a circle of a trajectory drawn by a distal end of the engaging portion and an axial line of the driven shaft intersect each other when viewing in an axial direction of the drive shaft, and a slope of the driven shaft with respect to a horizontal direction is an angle not larger than an angle of repose of the developer when viewing in an axial direction of the drive shaft.

The invention also provides a cleaning device, a developing device, a process cartridge, and an image forming apparatus.

According to the invention, a reduction in the size of the conveying device and the like is enabled by reducing a space for arrangement of a conveyance member configured to convey the developer.

Further features of the present invention will become apparent from the following description of exemplary embodiments with reference to the attached drawings.

DESCRIPTION OF THE EMBODIMENTS

Example 1

An embodiment of the invention will be described in detail with reference to the drawings below.

In a description of this specification, a direction of a rotation axis of an image bearing member is defined as a longitudinal direction.

In the longitudinal direction, a side where the image bearing member receives a driving force from a main body of an image forming apparatus is defined as a drive side, and an opposite side is defined as a non-drive side.

Figure 2:
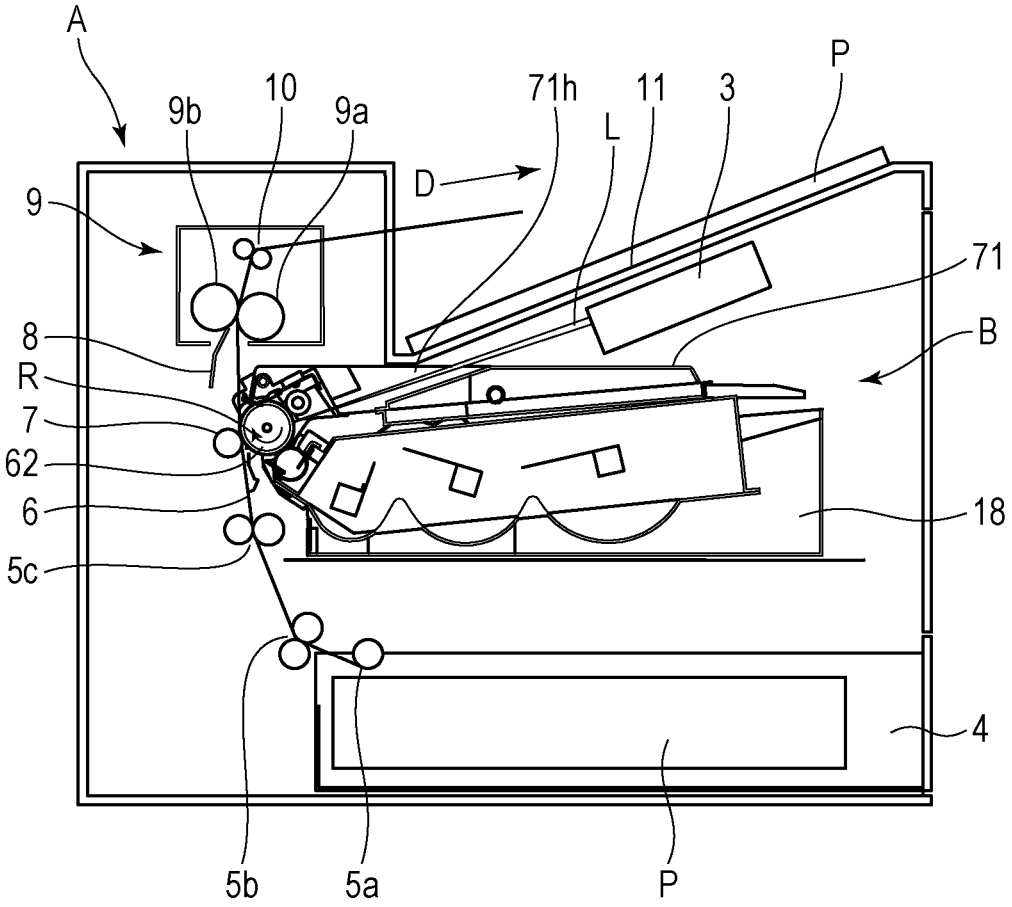
FIG. 2 is a cross-sectional view illustrating a main body and a process cartridge of the image forming apparatus in Example 1.

A general configuration and an image forming process of the image forming apparatus will be described with reference to FIG. 2 and FIG. 3. FIG. 2 is a cross-sectional view illustrating the main body of an electrophotographic image forming apparatus (hereinafter, referred to as a main body A) and a process cartridge (hereinafter, referred to as a cartridge B) according to an embodiment of the invention. The term "main body A" here corresponds to a portion of the electrophotographic image forming apparatus excluding the cartridge B. FIG. 2 is a cross-sectional view taken along a plane intersecting an axial line of the image bearing member. A lateral direction of the drawing corresponds to a horizontal direction, and a vertical direction of the plane corresponds to a direction of gravitational force.

Figure 3:
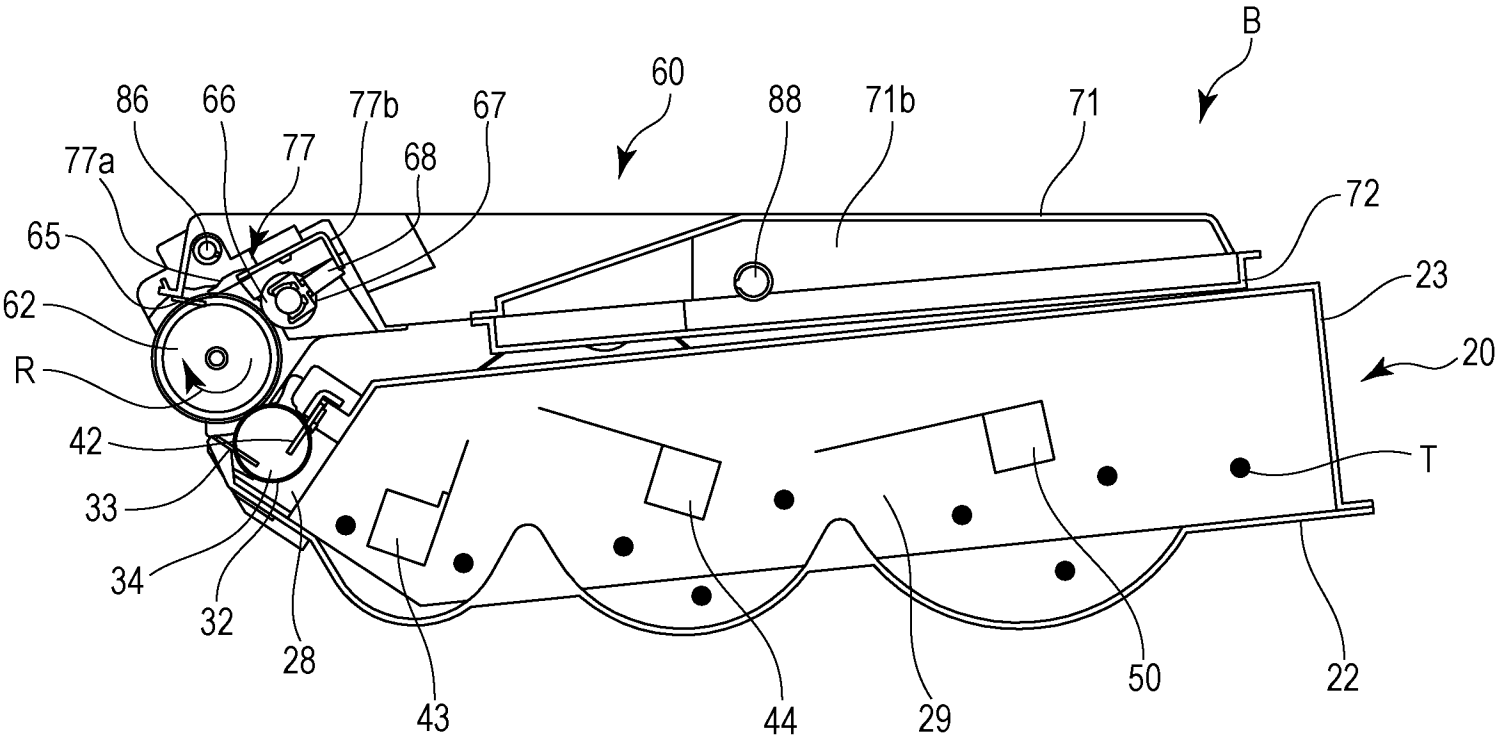
FIG. 3 is a cross-sectional view of the process cartridge in Example 1.

FIG. 3 is a cross-sectional view of the cartridge B.

General Configuration of Electrophotographic Image Forming Apparatus

The image forming apparatus illustrated in FIG. 2 is a laser beam printer using an electrophotographic technology, and the cartridge B is configured to be detachably attachable with respect to the main body A. An electrophotographic photosensitive drum 62, which corresponds to an image bearing member, (hereinafter, referred to as a drum 62) is arranged in the cartridge B. In a state in which the cartridge B is attached to the main body A, an exposing device 3 (a laser scanner unit) for forming a latent image on the drum 62 is arranged over the cartridge B. A sheet tray 4 containing a recording material (hereinafter, referred to as a sheet material P), which is an object on which an image is to be formed, is arranged under the cartridge B.

In addition, the main body A includes a pickup roller 5*a*, a feed roller pair 5*b*, a conveyance roller pair 5*c*, a transfer guide 6, a transfer roller 7, a conveyance guide 8, a fixing device 9, a discharge roller pair 10, and a discharge tray 11 arranged in this order along a conveyance direction D of the sheet material P. The fixing device 9 includes a heating roller 9*a* and a pressing roller 9*b*.

In Example 1, a configuration in which the process cartridge is detachably attachable with respect to the laser beam printer will be described. However, the detachably attachable configuration is not particularly limited to the process cartridge, and a configuration in which a container for supplementary toner or a developing device are detachably attachable independently is also applicable. In the same manner, a drum unit having a drum may be detachably attachable independently, or the drum may be fixed to the main body.

Image Forming Process

The image forming process is described roughly with reference to FIG. 2 and FIG. 3. The drum is rotatably driven in response to a print start signal, at a predetermined circumferential velocity (process speed) in a direction indicated by an arrow R.

A charging roller 66 having a bias voltage applied thereto comes into contact with an outer peripheral surface of the drum 62 and charges the outer peripheral surface of the drum 62. The exposing device 3 outputs a laser beam L in accordance with image information. The laser beam L passes through a laser opening 71*h* (FIG. 10) provided in a cleaning frame 71 of the cartridge B, and the outer peripheral surface of the drum 62 is scanned by and exposed to the laser beam L. Accordingly, an electrostatic latent image corresponding to the image information is formed on the outer peripheral surface of the drum 62.

The cartridge B of Example 1 includes the developing unit 20, which corresponds to a developing device, and the cleaning unit 60, which corresponds to a cleaning device. The developing unit 20 and the cleaning unit 60 are coupled to each other. The developing unit 20 accommodates a developer (hereinafter referred to as toner T) in a toner chamber 29. The developer is stirred and conveyed by rotation of a first stirring member 43, a second stirring member 44, and a third stirring member 50. The stirred and conveyed toner T is delivered to a toner supply chamber 28.

The toner T is born on a surface of a developing roller (a developing sleeve) 32 as a developer bearing member by a magnetic force of a magnet roller 34 (a fixed magnet). A developing blade 42 controls the thickness of the toner T on a peripheral surface of the developing roller 32 while triboelectrically charging the toner T. The toner T is developed onto the drum 62 in accordance with the electrostatic latent image, and is visualized as a developer image (a toner image).

As illustrated in FIG. 2, the sheet material P contained in a lower portion of the main body A is fed from a sheet tray 4 by the pickup roller 5*a*, the feed roller pair 5*b*, and the conveyance roller pair 5*c* at the same timing as the output of the laser beam L. Then, the sheet material P passes through the transfer guide 6, and is conveyed to a transfer position between the drum 62 and the transfer roller 7. At this transfer position, toner images are sequentially transferred from the drum 62 to the sheet materials P.

The sheet material P having the toner image transferred thereto is separated from the drum 62 and is conveyed along the conveyance guide 8 to the fixing device 9. The sheet material P then passes through a nip portion between the heating roller 9*a* and the pressing roller 9*b* which constitute parts of the fixing device 9. At the nip portion, pressurization and heat-fixation are performed to fix the toner image to the sheet material P. The sheet material P that has been subjected to the fixation of the toner image is conveyed to the discharge roller pair 10, and is discharged to the discharge tray 11 located in a direction D.

In contrast, as illustrated in FIG. 3, residual toner on the outer peripheral surface of the drum 62 after the transfer is removed by a cleaning blade 77, and the drum 62 is used for the next image forming process again. The toner removed from the drum 62 passes from a first conveyance member 86 through a second conveyance member, which is not illustrated in FIG. 3, and then passes through a third conveyance member 88, and is stored in a waste toner chamber 71*b* in the cleaning unit 60.

In Example 1, the charging roller 66, the developing roller 32, the transfer roller 7, and the cleaning blade 77 correspond to process devices that act on the drum 62.

Attaching and Detaching of Cartridge

Attaching and detaching of the cartridge B to the main body A will be described below with reference to FIG. 5 and FIG. 6.

Figure 5:
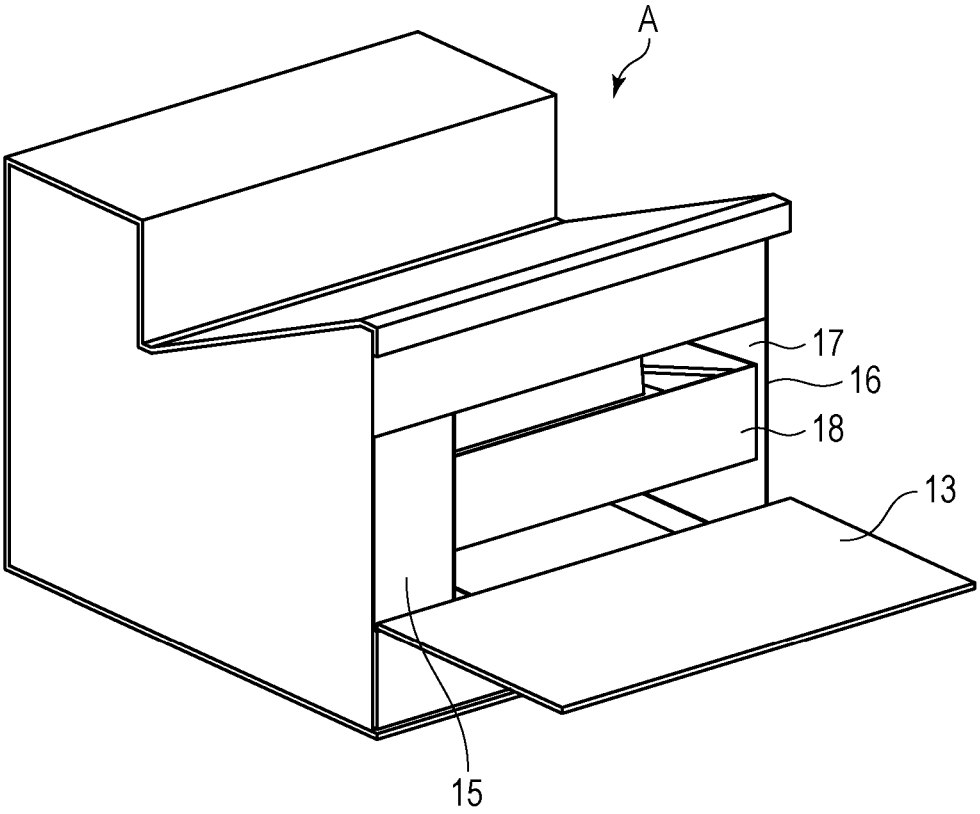
FIG. 5 is a perspective view of the main body of the image forming apparatus in Example 1 in a state in which an opening and closing door of the image forming apparatus is opened.
Figure 6:
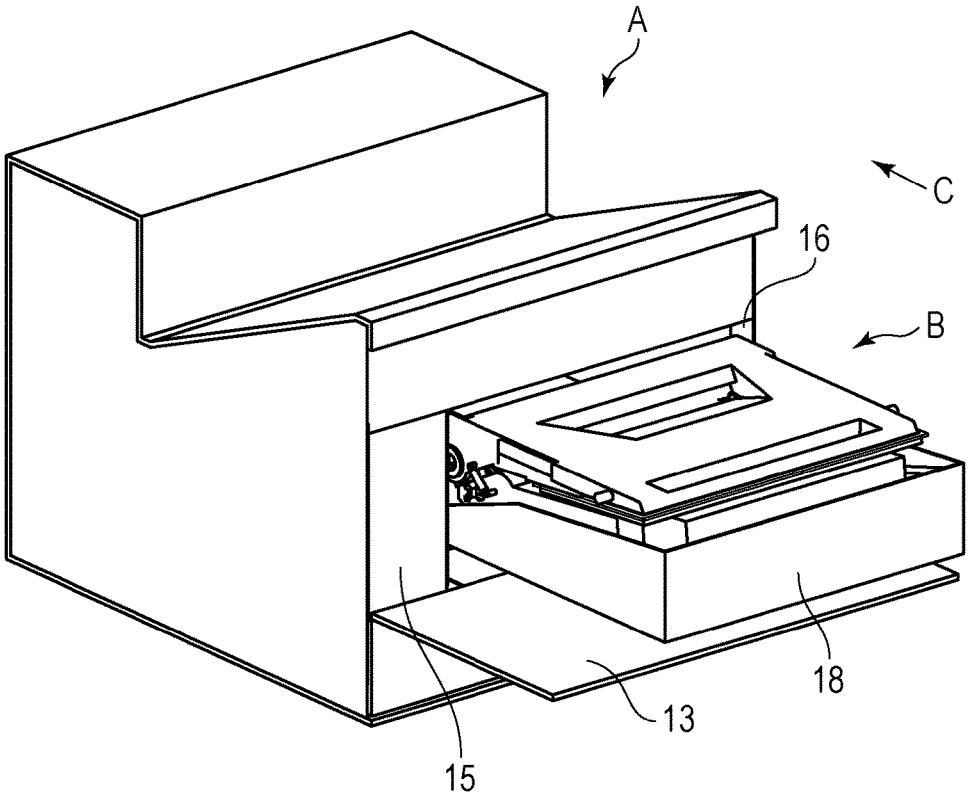
FIG. 6 is a perspective view of the main body of the image forming apparatus in Example 1 in a state in which the opening and closing door of the image forming apparatus is opened and the tray is pulled out.
Figure 7:
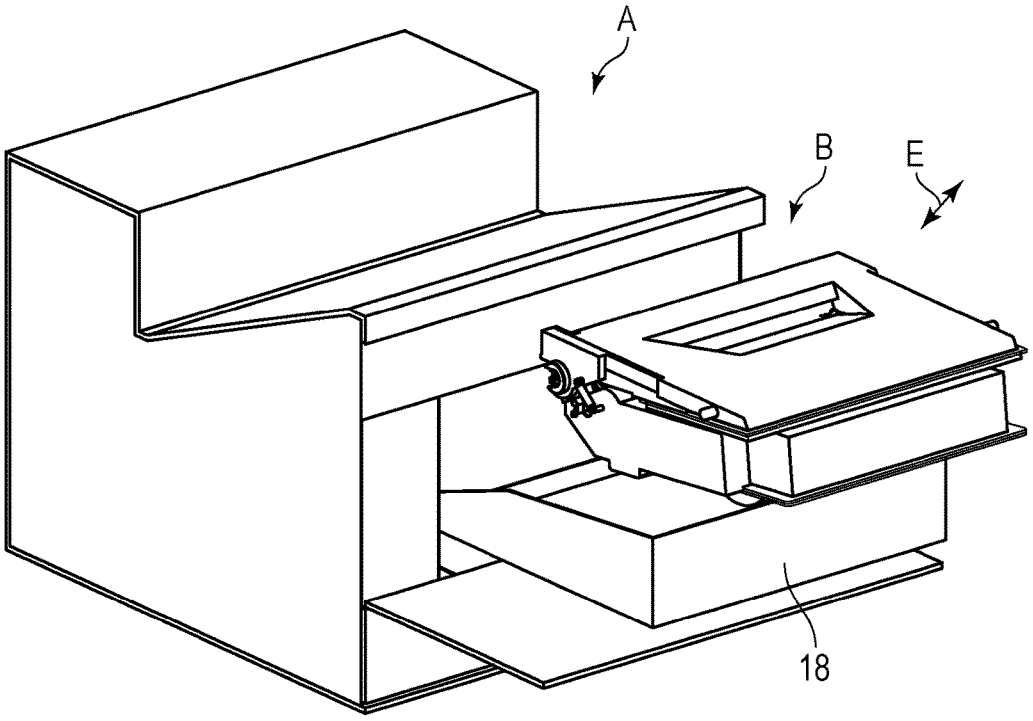
FIG. 7 is a perspective view of the main body and the process cartridge of the image forming apparatus illustrating a state when attaching and detaching the process cartridge to the tray in a state in which the opening and closing door of the image forming apparatus in Example 1 is opened and the tray is pulled out.

FIG. 5 is a perspective view of the main body A in a state in which an opening and closing door 13 is opened for attaching and detaching the cartridge B. FIG. 6 is a perspective view of the main body A and the cartridge B in a state in which the opening and closing door 13 is opened and the cartridge tray 18 as a pulling-out mechanism is pulled out for attaching and detaching the cartridge B. FIG. 7 is a perspective view of the main body A and the cartridge B when attaching and detaching the cartridge B in the state in which the opening and closing door 13 is opened and the cartridge tray 18 is pulled out. The cartridge B is detachably attached to the cartridge tray 18 in an attaching and detaching direction E. The attaching and detaching direction of Example 1 corresponds to a direction intersecting a pulling out direction, and the cartridge B is moved to a position over the cartridge tray 18. The pulling out direction of the cartridge tray 18 is a horizontal direction with respect to the main body A.

The opening and closing door 13 is pivotably mounted on the main body A. When the opening and closing door 13 is opened, a cartridge insertion port 17 is provided. The cartridge tray 18 for attaching the cartridge B to the main body A is provided in the cartridge insertion port 17. When the cartridge tray 18 is pulled out to a predetermined position, attaching and detaching of the cartridge B are enabled. The cartridge B is attached to the interior of the main body A along a guide rail (not illustrated) in a direction indicated by an arrow C in FIG. 6 in a state of being attached to the cartridge tray 18.

In addition, the main body A includes a first main body drive shaft 14 and a second main body drive shaft 19 configured to transmit a driving force respectively to a first coupling 70 and a second coupling 21 (FIG. 8) provided on the cartridge B. The first main body drive shaft 14 and the second main body drive shaft 19 are driven by a motor (not illustrated) of the main body A. Accordingly, the drum 62 coupled to the first coupling 70 receives a driving force from the main body A and rotates. The developing roller 32 rotates upon transmission of a driving force from the second coupling 21. The charging roller 66 and the developing roller 32 receive a supply of electricity from a power feeding unit (not illustrated) of the main body A.

Supporting of Cartridge

Figure 8:
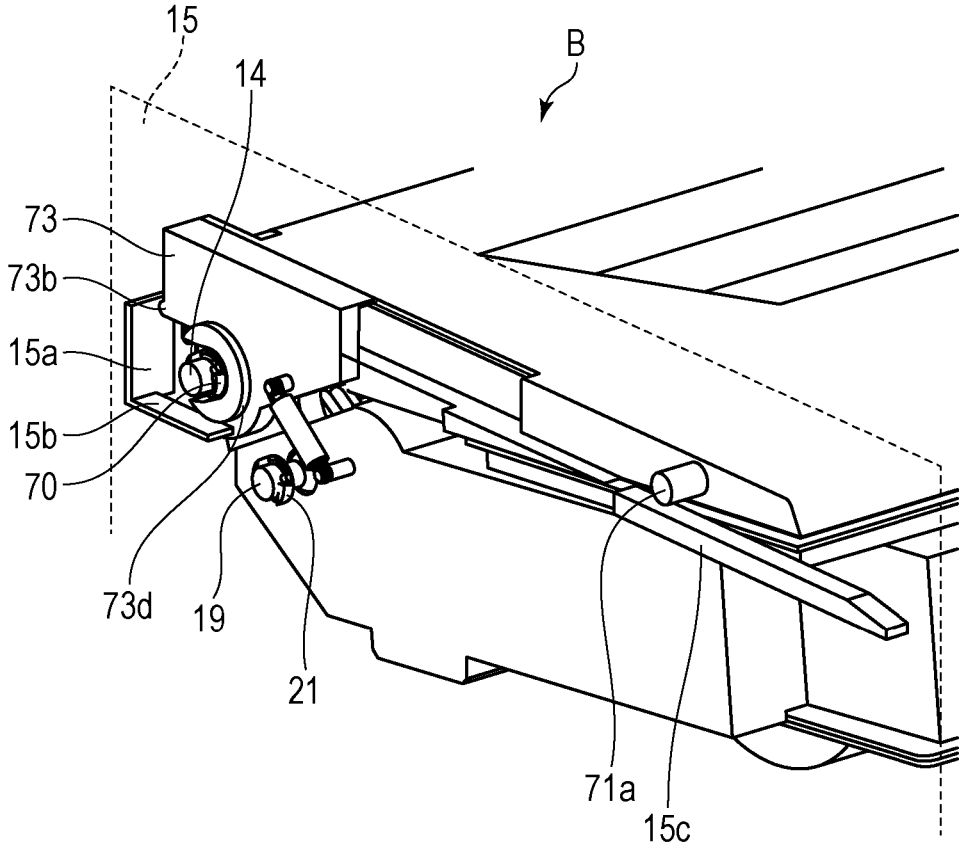
FIG. 8 is a perspective view of the process cartridge and drive-side supporting portions of the main body of the image forming apparatus in a state in which the process cartridge is attached to the main body of the image forming apparatus in Example 1.
Figure 9:
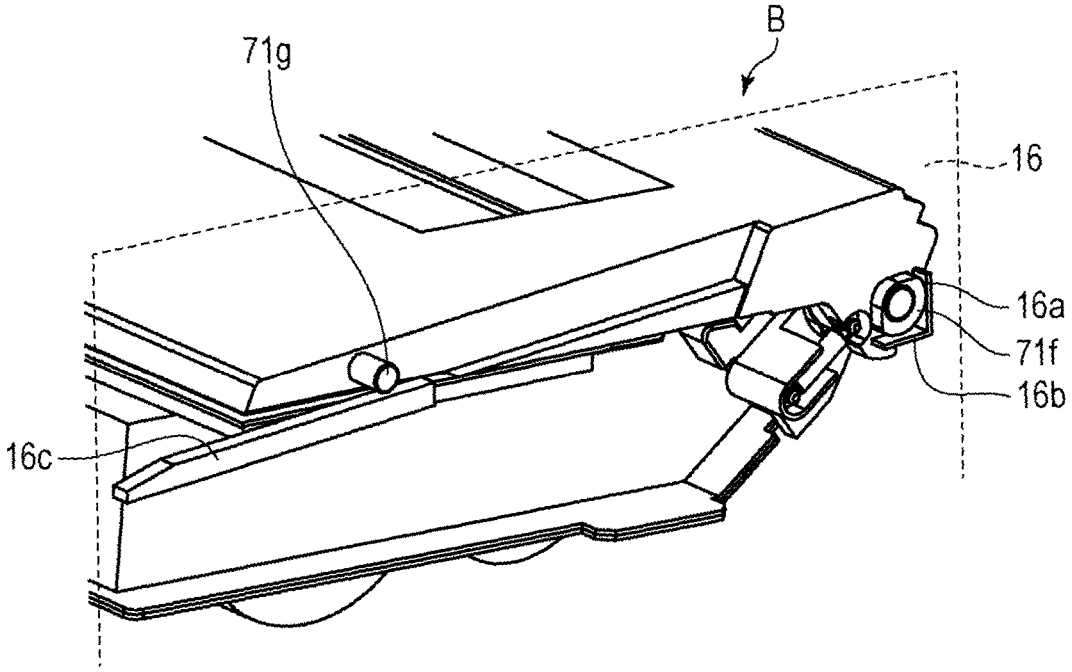
FIG. 9 is a perspective view of the process cartridge and non-drive-side supporting portions of the main body of the image forming apparatus in the state in which the process cartridge is attached to the main body of the image forming apparatus in Example 1.

As illustrated in FIG. 5, the main body A is provided with a drive-side panel 15 and a non-drive-side panel 16 for supporting the cartridge B. As illustrated in FIG. 8, the drive-side panel 15 is provided with a drive-side first supporting portion 15*a*, a drive-side second supporting portion 15*b*, and a rotation supporting portion 15*c* for supporting the cartridge B. As illustrated in FIG. 9, the non-drive-side panel 16 includes a non-drive-side first supporting portion 16*a*, a non-drive-side second supporting portion 16*b*, and a rotation supporting portion 16*c*.

In contrast, as illustrated in FIG. 8, a supported portion 73*b* and a supported portion 73*d* of the drum bearing 73 and a drive-side boss 71*a* of the cleaning frame 71 are provided on the drive side as supported portions of the cartridge B. A non-drive-side projection 71*f* and a non-drive-side boss 71*g* are provided on the non-drive side as illustrated in FIG. 9. The supported portion 73*b* is supported by the drive-side first supporting portion 15*a*. The supported portion 73*d* is supported by the drive-side second supporting portion 15*b*. The drive-side boss 71*a* is supported by the rotation supporting portion 15*c*. The non-drive-side projection 71*f* is supported by the non-drive-side first supporting portion 16*a* and the non-drive-side second supporting portion 16*b*. The non-drive-side boss 71*g* is supported by the rotation supporting portion 16*c*. Accordingly, the cartridge B is positioned in the main body A.

General Configuration of Cartridge

Figure 10:
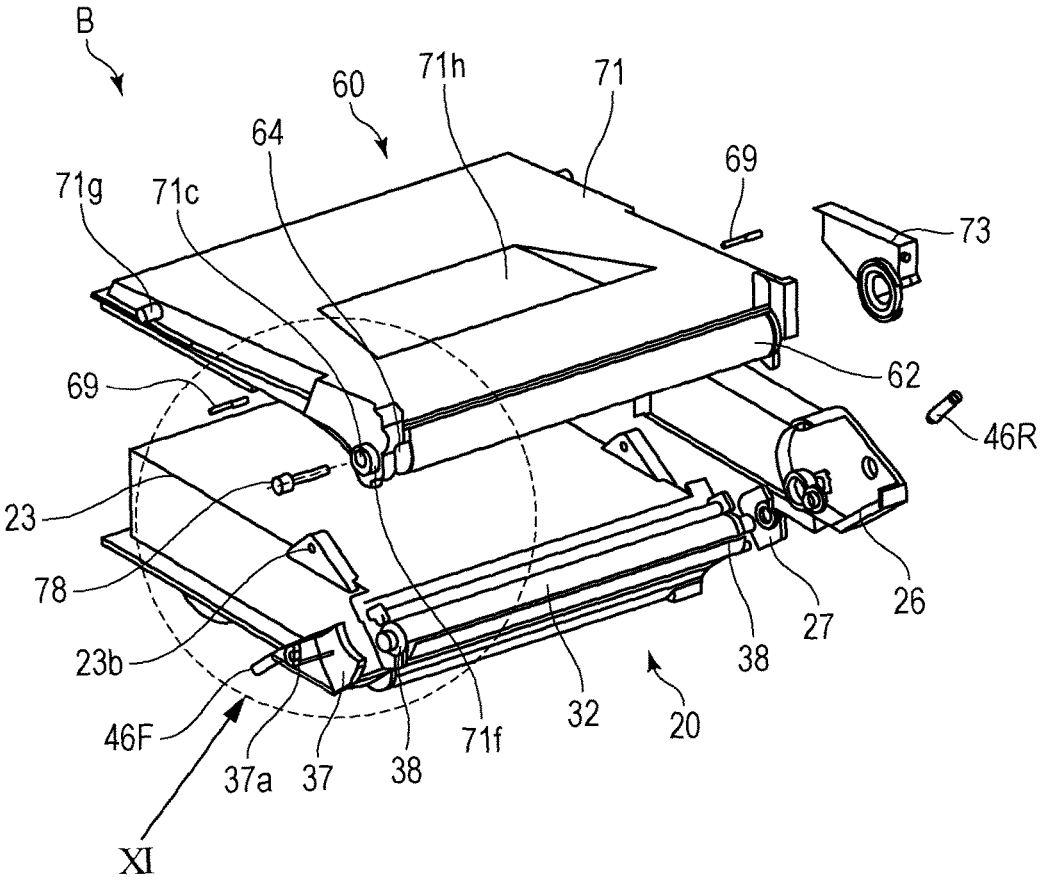
FIG. 10 is an exploded view of the process cartridge in Example 1.
Figure 11:
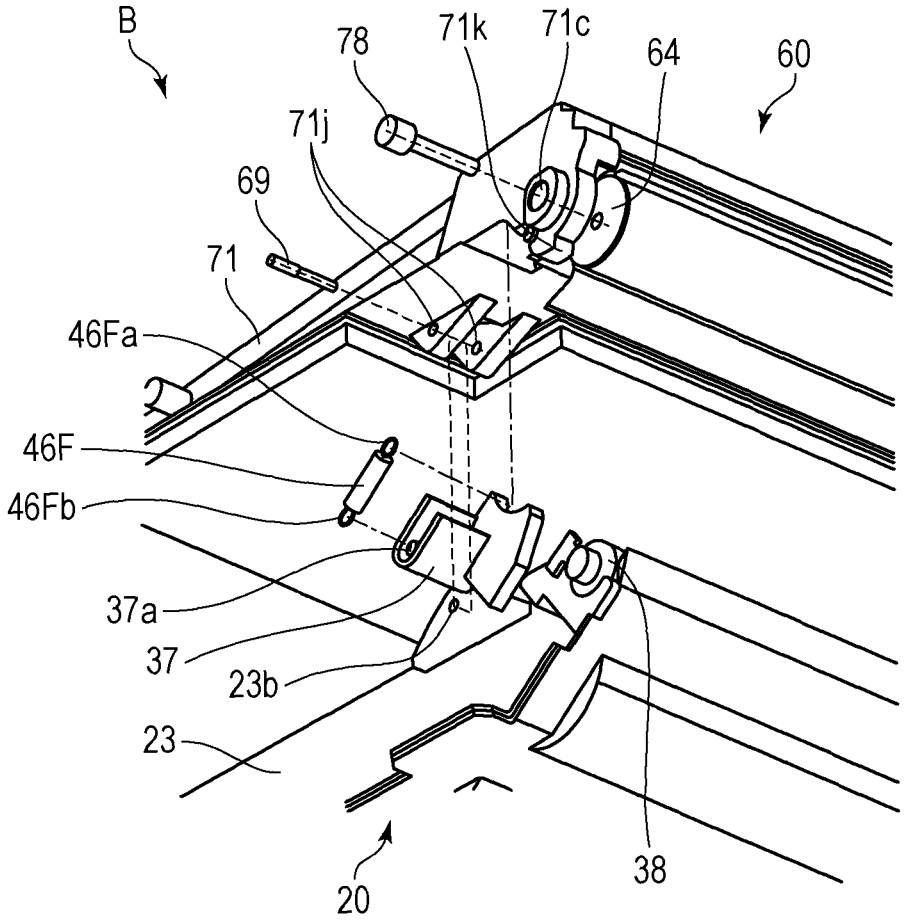
FIG. 11 is an exploded view of the process cartridge in Example 1.
Figure 12:
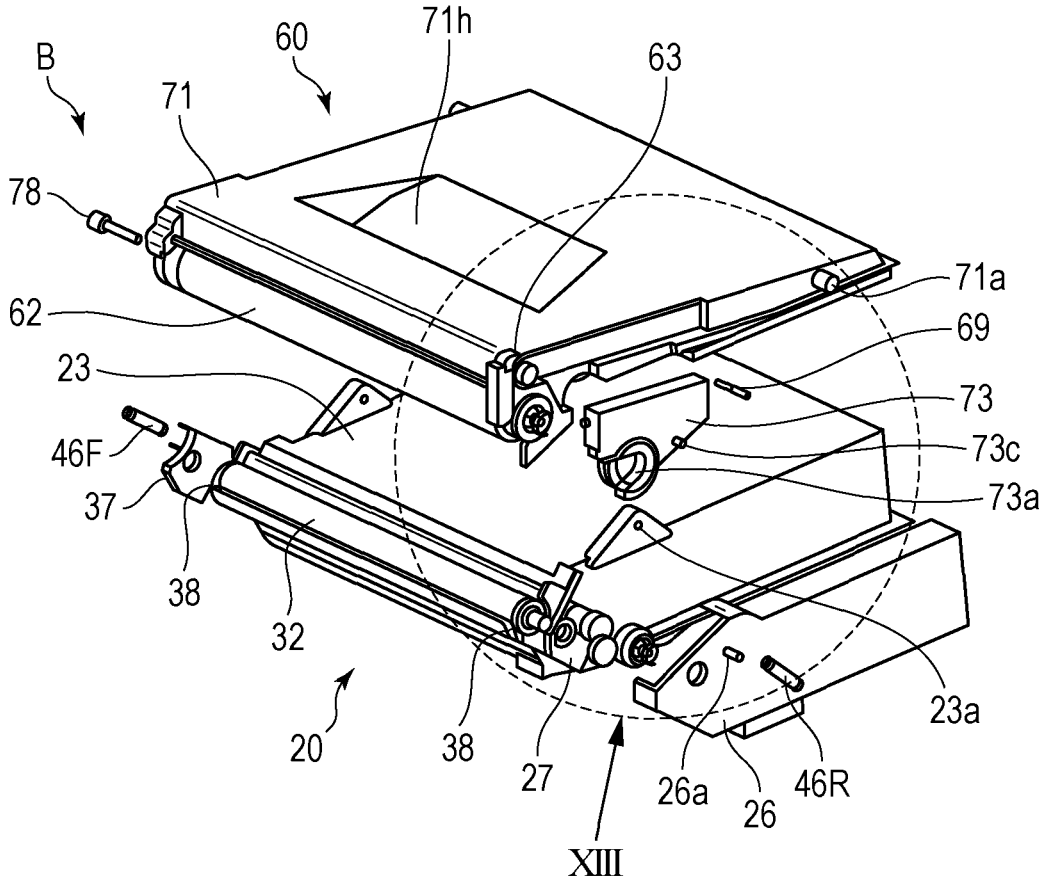
FIG. 12 is an exploded view of the process cartridge in Example 1.
Figure 13:
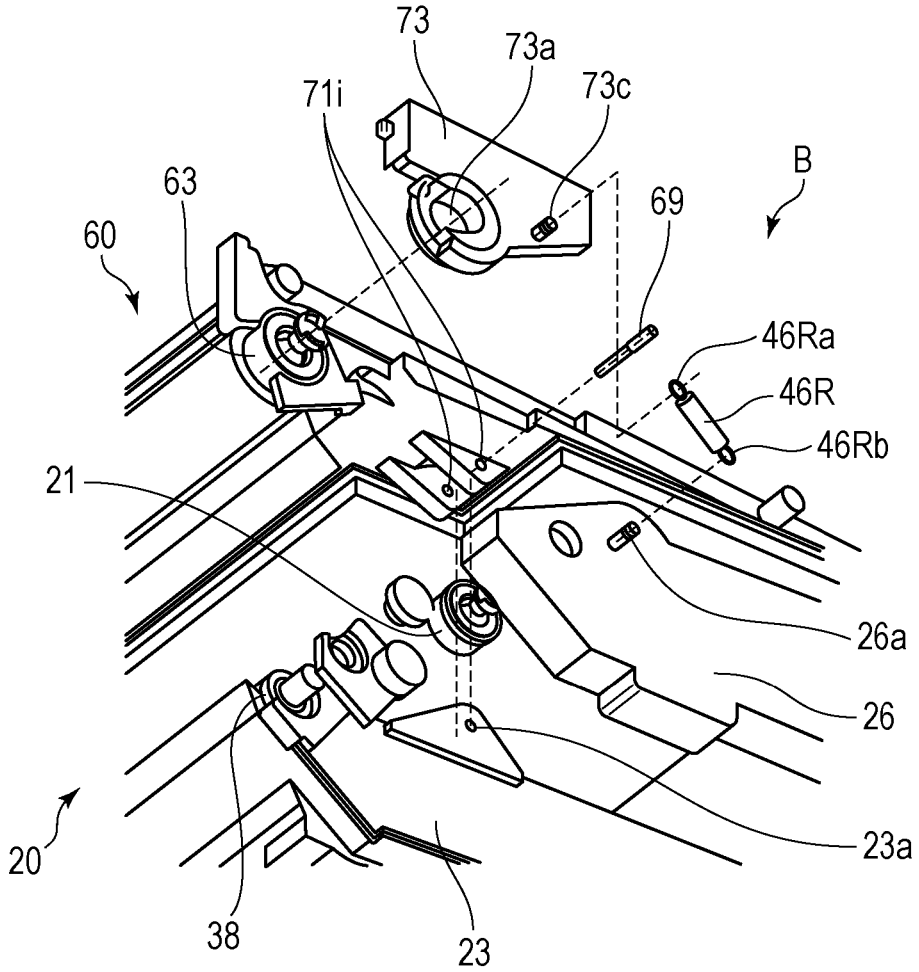
FIG. 13 is an exploded view of the process cartridge in Example 1.

A general configuration of the cartridge B will be described with reference to FIG. 3, FIGS. 4A and 4B, FIG. 10, FIG. 11, FIG. 12 and FIG. 13 below. FIG. 3 is a cross-sectional view of the cartridge B, FIG. 10, FIG. 11, FIG. 12, and FIG. 13 are perspective views for explaining the configuration of the cartridge B. FIG. 11 and FIG. 13 are partly enlarged views illustrating portions within dot lines XI and XIII in FIG. 10 and FIG. 12 viewing from a different angle in an enlarged scale. In Example 1, a description of screws used for coupling components is omitted.

As illustrated in FIG. 3, the cartridge B of Example 1 includes the cleaning unit 60 having a conveying mechanism (conveying device) configured to convey the developer, and the developing unit 20. In Example 1, the process cartridge including the cleaning unit 60 and the developing unit 20 coupled to each other is described. However, the configuration of the process cartridge is not particularly limited to the configuration described above. The cleaning unit 60 may be an independent cleaning device, or the developing unit 20 may be an independent developing device. A developing device having a conveying mechanism is also applicable depending on the configuration. For example, in the case where the developer is collected and is reused for another development, the developer may be collected by using the conveying mechanism.

As illustrated in FIG. 3, the cleaning unit 60 includes the drum 62, the charging roller 66, a cleaning member 77, the cleaning frame 71 as a developer accommodating container configured to support these members, and a lid member 72 fixed to the cleaning frame 71 by adhesion or the like. In the cleaning unit 60, the charging roller 66 and the cleaning member 77 are arranged to be in contact with the outer peripheral surface of the drum 62.

The cleaning member 77 of Example 1 includes a rubber blade 77*a*, which is a blade-shaped elastic member formed of rubber as an elastic material, and a supporting member 77*b* configured to support the rubber blade 77*a*. The rubber blade 77*a* is in contact with the drum 62 in a direction opposite to the rotational direction of the drum 62. In other words, the rubber blade 77*a* is in contact with the drum 62 with a distal end portion thereof facing upstream of the rotational direction of the drum 62. Although the cleaning member has been described as the cleaning blade in Example 1, the cleaning member is not particularly limited to the cleaning blade, and a roller-type cleaning member may also be employed.

Figure 4A:
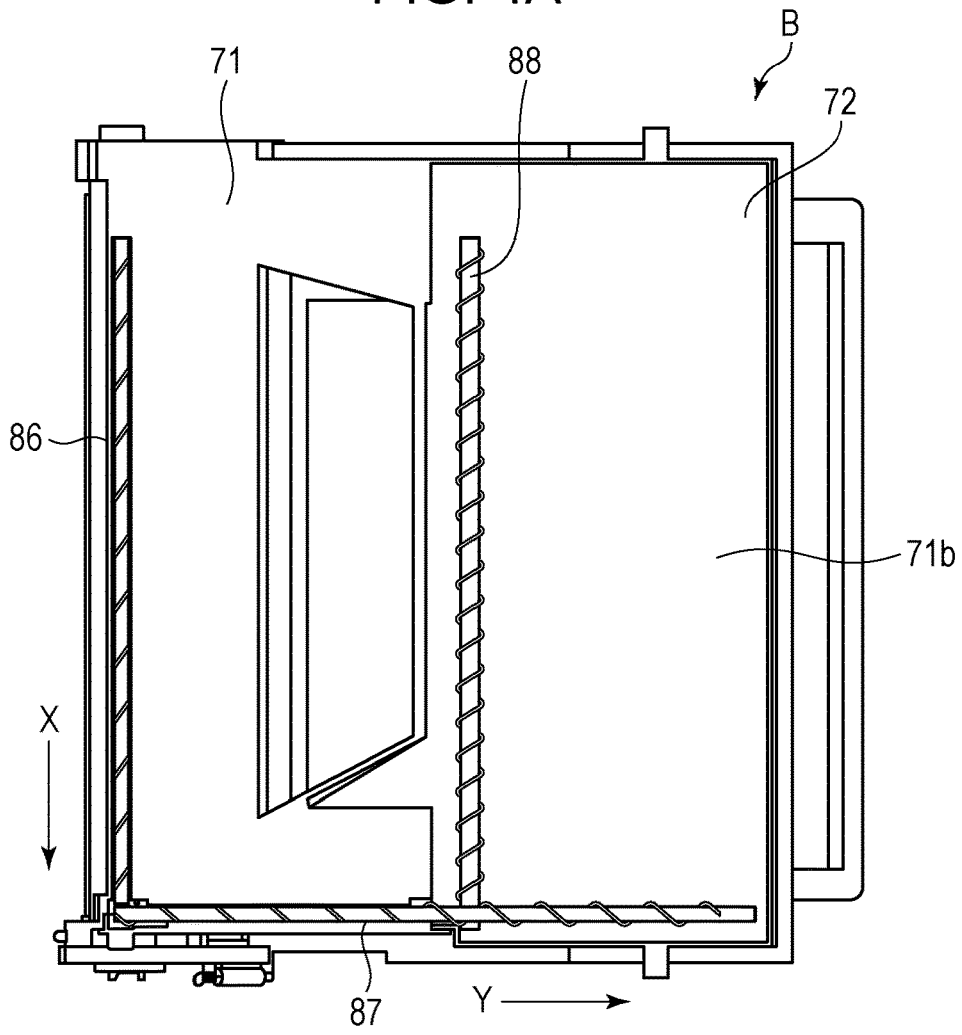
FIG. 4A is a cross-sectional view of an interior of the cleaning case of the process cartridge in Example 1 taken along a line IVA-IVA in FIG. 4B.
Figure 4B:
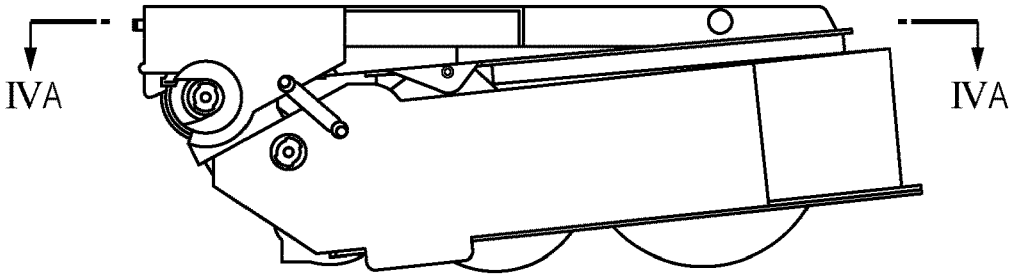
FIG. 4B is a side view of the process cartridge in Example 1.

FIG. 4A is a cross-sectional view of the cleaning frame 71. As illustrated in FIG. 3 and FIG. 4A, a waste developer (hereinafter, referred to as "waste toner") removed from the surface of the drum 62 by the cleaning member 77 is conveyed by a conveyance member. The conveyance member includes at least a shaft and a conveying portion configured to convey the toner. In the invention, the first conveyance member includes a drive shaft, a developer conveying portion, and a drive transmission portion configured to transmit a driving force. The second conveyance member includes a driven shaft, a developer conveying portion, and a driving force receiving portion configured to receive the driving force from the drive transmission portion.

In Example 1, a case where the conveyance member is a screw will be described. As illustrated in FIG. 4, a first screw 86 is provided as the first conveyance member. The first screw 86 conveys the toner in a direction indicated by an arrow X. A second screw 87, which corresponds to the second conveyance member, is arranged downstream of the first screw 86 in a conveyance direction of the toner. The second screw 87 conveys the toner in a direction indicated by an arrow Y. A third screw 88, which corresponds to the third conveyance member, is provided downstream of the second screw 87 in the conveyance direction of the toner in the waste toner chamber 71*b* formed by the cleaning frame 71 and the lid member 72. The toner is accumulated in the waste toner chamber 71*b*. The first screw 86 is rotated by a gear (not illustrated) upon transmission of a drive force from the coupling 21 illustrated in FIG. 13. The second screw 87 is rotated by a driving force transmitted from the first screw 86, and the third screw 88 is rotated by a driving force transmitted from the second screw 87. The first screw 86 is arranged in the vicinity of the drum 62, the second screw 87 is arranged at an end side (the drive side) in the longitudinal direction of the cleaning frame 71, and the third screw 88 is arranged in the waste toner chamber 71*b*. In Example 1, the rotation axes of the first screw 86 and the third screw 88 are parallel to a rotation axis of the drum 62, and a rotation axis of the second screw 87 is orthogonal to the rotation axis of the drum 62. However, this arrangement relationship is not necessarily required as long as the driving force is transmitted and the toner can be conveyed. For example, the axial line of the first screw and the axial line of the second screw are only required to intersect each other. Therefore, a configuration in which the axial line of the second screw is inclined inward from the end portion of the cartridge B in the longitudinal direction is also applicable. The positional relationship between the axial line of the first screw and the axial line of the third screw may be intersection instead of parallelism.

Figure 14:
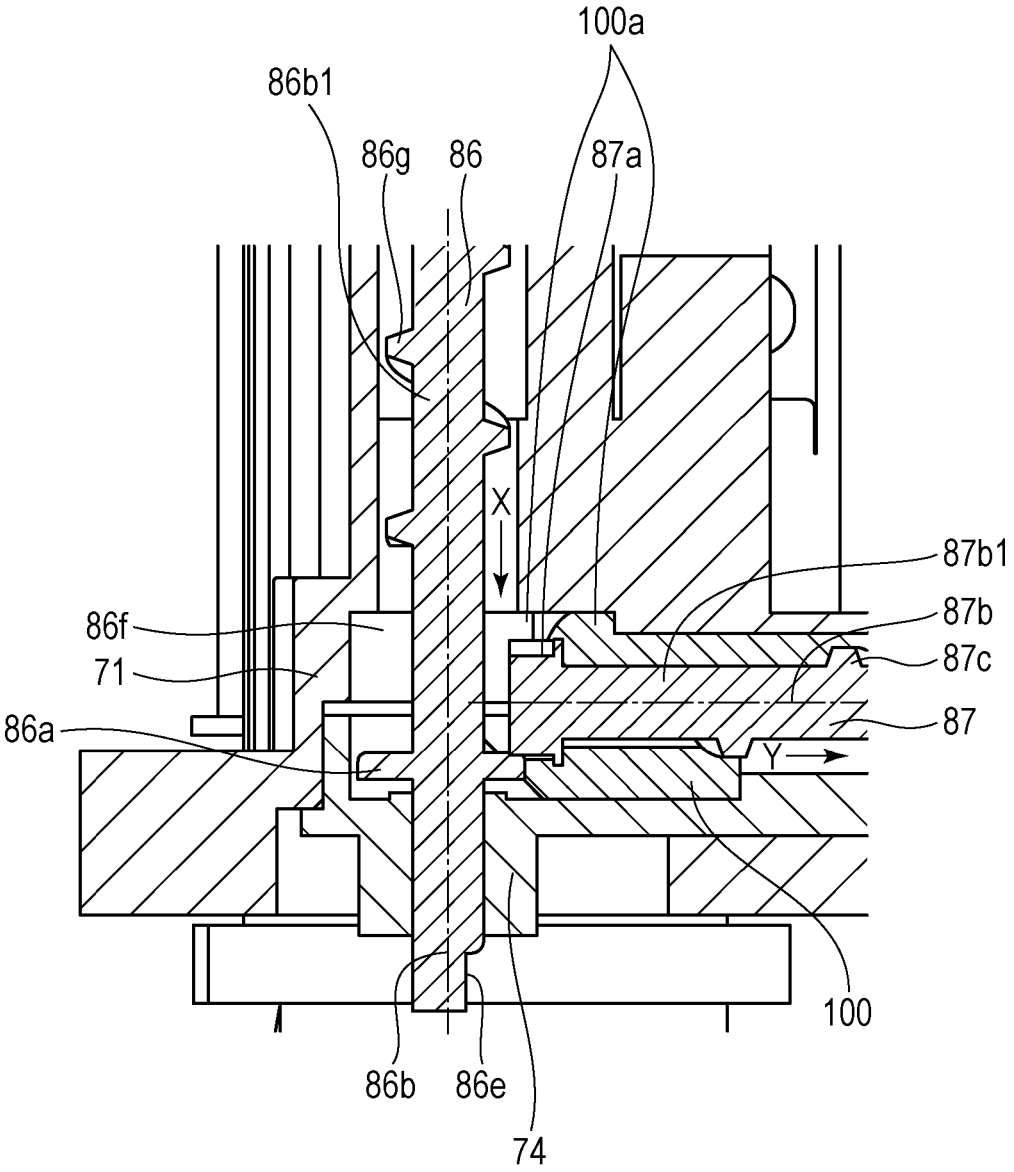
FIG. 14 is a cross-sectional view of a waste toner flow channel in Example 1 taken along a line XIV-XIV in FIG. 1.

The screw as the conveyance member is provided with a developer conveying portion 86*g* configured to convey the toner (FIG. 14). The developer conveying portion 86*g* is only required to convey the waste toner, and thus a configuration having a helical projecting portion as in FIG. 14 and a configuration having a shape including a plurality of twisted blades are also applicable. The conveyance member is not particularly limited to the screw, and a configuration in which the waste toner is conveyed by a coil or the like, for example, is also applicable as long as the waste toner can be conveyed in the direction of axis of the conveyance member.

As illustrated in FIG. 3, a drum contact sheet 65 for preventing leakages of the waste toner from the cleaning frame 71 is provided at an edge portion of the cleaning frame 71 so as to come into contact with the drum 62. The drum 62 receives a driving force from a main body driving motor (not illustrated), which corresponds to a driving source, thereby rotating in a direction indicated by an arrow R in the drawing in accordance with an image forming operation.

The charging roller 66 is rotatably mounted on the cleaning unit 60 via charging roller bearings 67 at both end portions in the longitudinal direction of the cleaning frame (substantially parallel to the direction of an axis of rotation of the drum 62). The charging roller 66 is in pressure contact with the drum 62 by the charging roller bearings 67 being pressed by biasing members 68 toward the drum 62. The charging roller 66 rotates following the rotation of the drum 62.

As illustrated in FIG. 3, the developing unit 20 includes the developing roller 32, a developer container 23 configured to support the developing roller 32, and the developing blade 42. The magnet roller 34 is provided in the developing roller 32. The developing blade 42 configured to control a toner layer is arranged over the developing roller 32. As illustrated in FIG. 10 and FIG. 12, the developing roller 32 includes distance holding members 38 mounted on both end portions of the developing roller 32. The distance holding members 38 come into contact with the drum 62 to hold the developing roller 32 and the drum 62 with a small gap formed therebetween. As illustrated in FIG. 3, a developing roller contact sheet 33 configured to prevent leakages of toner from the developing unit 20 is provided at an edge portion of a bottom member 22 so as to come into contact with the developing roller 32. In addition, the first stirring member 43, the second stirring member 44, and the third stirring member 50 are provided in the toner chamber 29 formed by the developer container 23 and the bottom member 22. The first stirring member 43, the second stirring member 44, and the third stirring member 50 stir the toner accommodated in the toner chamber 29 and convey the toner to a toner supply chamber 28.

As illustrated in FIG. 10 and FIG. 12, the cartridge B includes the cleaning unit 60 and the developing unit 20 combined with each other.

The cleaning unit 60 is provided with the cleaning frame 71, the lid member 72, the drum 62, the drum bearing 73 configured to rotatably support the drum 62, and a drum shaft 78. As illustrated in FIG. 13, a drive-side drum flange 63 provided on the drive side of the drum 62 is rotatably supported by a hole portion 73*a* of the drum bearing 73. In contrast, as illustrated in FIG. 11, the non-drive side is configured in such a manner that the drum shaft 78 press-fitted into a hole portion 71*c* provided in the cleaning frame 71 rotatably supports the hole portion of a non-drive-side drum flange 64.

As illustrated in FIG. 3, FIG. 10, and FIG. 12, the developing unit 20 includes the bottom member 22, the developer container 23, a drive-side side member 26, the developing blade 42, and the developing roller 32. The developing roller 32 is rotatably mounted on the developer container 23 by bearing members 27 and 37 provided at both ends thereof.

As illustrated in FIG. 11 and FIG. 13, the cleaning unit 60 and the developing unit 20 are pivotably coupled to each other by coupling pins 69 to constitute part of the cartridge B.

Specifically, a first supporting hole 23*a* and a second supporting hole 23*b* are provided in the developer container 23 at both end portions in the longitudinal direction of the developing unit 20. A first hanging holes 71*i* and a second hanging holes 71*j* are provided in the cleaning frame 71 at both end portions in the longitudinal direction of the cleaning unit 60. The coupling pins 69 fixedly press-fitted to the first hanging holes 71*i* and the second hanging holes 71*j* are fitted into the first supporting hole 23*a* and the second supporting hole 23*b*. Thus, the cleaning unit 60 and the developing unit 20 are coupled pivotably with respect to each other.

A first hole portion 46Ra of a drive-side biasing member 46R is hooked on a boss 73*c* of the drum bearing 73, and a second hole portion 46Rb is hooked on a boss 26*a* of the drive-side side member 26.

A first hole portion 46Fa of a non-drive-side biasing member 46F is hooked on a boss 71*k* of the cleaning frame 71, and a second hole portion 46Fb of the non-drive-side biasing member 46F is hooked on a boss 37*a* of the bearing member 37.

In Example 1, the drive-side biasing member 46R and the non-drive-side biasing member 46F are each formed of an extension spring. The developing unit 20 is biased toward the cleaning unit 60 by biasing forces of the springs, and thus the developing roller 32 is reliably pressed against the drum 62. The developing sleeve, which corresponds to the developing roller 32, is held at a predetermined distance from the drum 62 by the distance holding members 38 mounted on both end portions of the developing roller 32.

Figure 15:
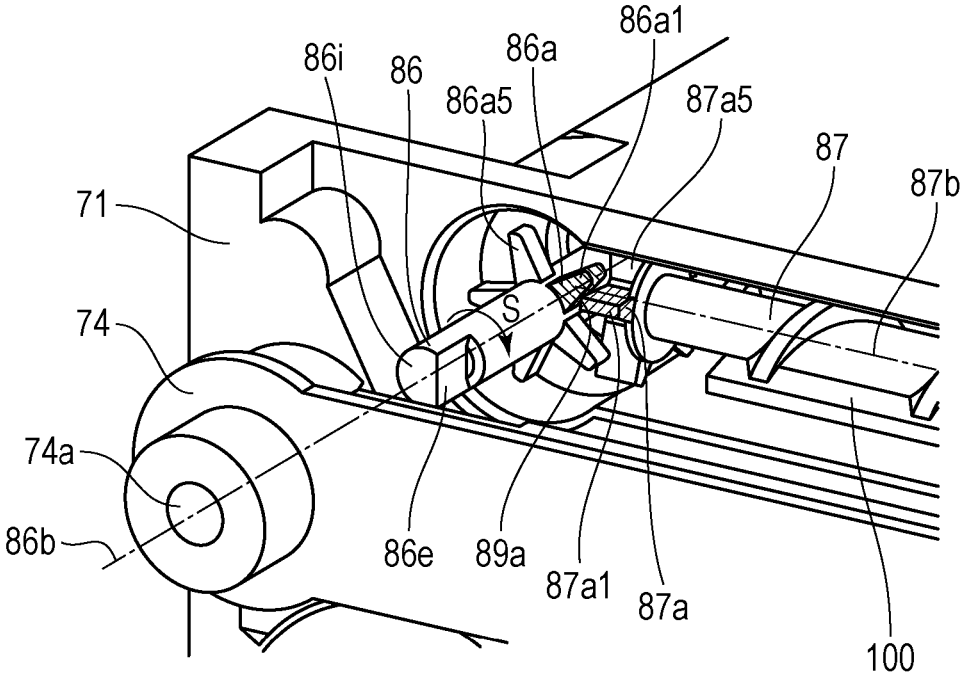
FIG. 15 is a perspective view of a drive coupling portion between a first screw and a second screw in Example 1.

A general configuration of the waste toner conveyance by the first screw 86 and the second screw 87 will be described with reference to FIG. 14 and FIG. 15. FIG. 14 is a cross-sectional view of a waste toner flow channel 100, which corresponds to the developer conveying path. The developer conveying path is provided within a frame, and is a conveying path for conveying a developer. In Example 1, the conveying path configured to convey toner is formed by adhering the cleaning frame and the lid member. FIG. 15 is a perspective view of the coupling portion between the first screw 86 and the second screw 87.

As illustrated in FIG. 14, the first screw 86 and the second screw 87 include helical blades 86*g* and 87*c* as the developer conveying portions, respectively. Accordingly, the waste toner is conveyed in a direction indicated by an arrow X and a direction indicated by an arrow Y by axial rotation of the respective screws.

As illustrated in FIG. 15, the first screw 86 and the second screw 87 are rotatably retained in the waste toner flow channel 100 formed by the cleaning frame 71 and a screw lid 74.

Specifically, the end portion of the first screw 86 on the drive coupling portion side is inserted into a hole 74*a* of the screw lid 74, and the other end portion is inserted into a hole (not illustrated) provided in the cleaning frame 71.

At this time, the first screw 86 faces the drum 62, and is arranged in parallel thereto. Accordingly, the first screw 86 faces a waste toner generating source on the drum 62 over the entire area in the axial direction, and thus conveyance performance is improved.

As illustrated in FIG. 15, a D-cut surface 86*e*, which corresponds to an input portion of the first screw 86, passes through the hole 74*a* provided in the screw lid 74, projects to an exterior of the waste toner flow channel 100, and is coupled to a gear (not illustrated), so that the first screw 86 rotates in the waste toner flow channel 100.

A sponge-type (not illustrated) seal member is arranged in a gap between the first screw 86 and the hole 74*a* to prevent leakages of the toner from the waste toner flow channel 100 to the exterior.

Figure 1:
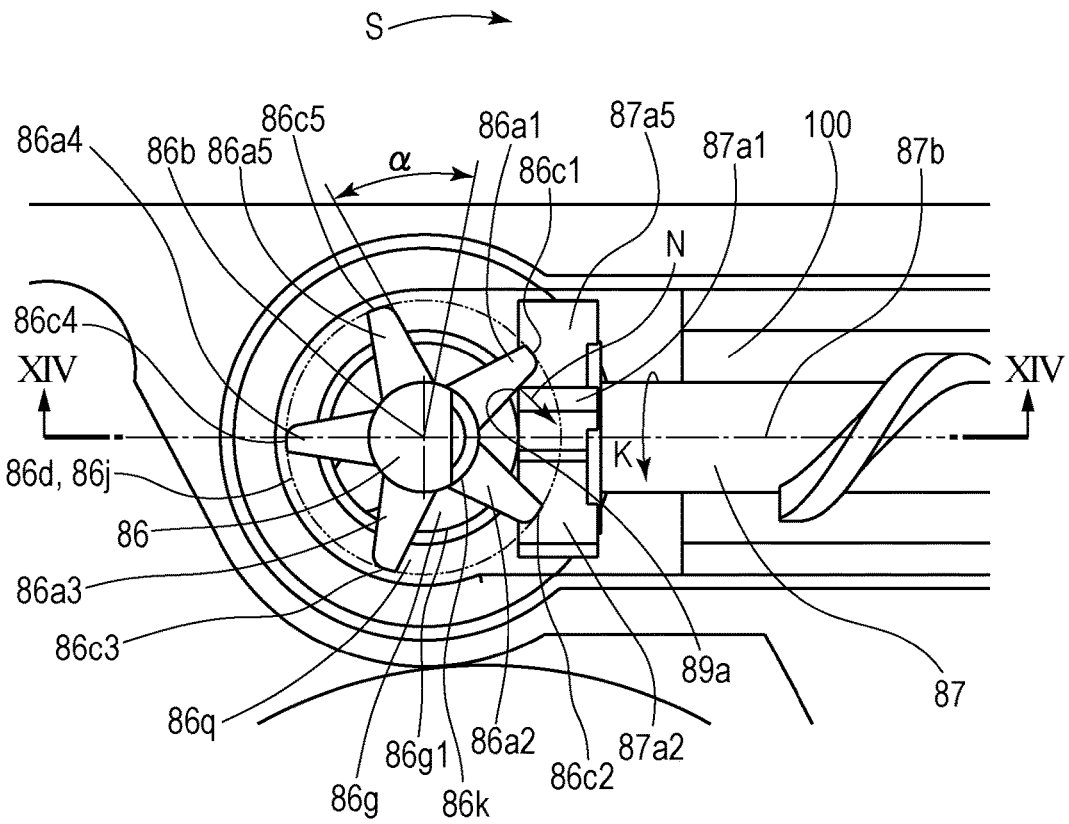
FIG. 1 is a drawing illustrating a drive coupling portion between a first screw and a second screw in Example 1 viewing in an axial direction of the first screw.

As illustrated in FIG. 1, the first screw 86 is provided with a drive transmission portion 86*a* including five engaging blades 86*a*1 to 86*a*5, which corresponds to engaging portions projecting from a drive shaft 86*b*1. The second screw 87 is provided with a driving force receiving portion 87*a* including five engaged blades 87*a*1 to 87*a*5, which correspond to engaged portions projecting from a driven shaft 87*b*1 (see FIG. 1).

However, the numbers of the engaging blades and the engaged blades are not particularly limited to five. The numbers of the engaging blades and the engaged blades are not particularly limited as long as there are at least one engaging blade and two engaged blades, and a driving force can be transmitted therebetween.

In other words, a configuration of the first screw, which corresponds to the first conveyance member of Example 1, includes the drive shaft 86*b*1 and the drive transmission portion 86*a*, and the drive transmission portion 86*a* includes engaging portions 86*a*1 to 86*a*5 projecting from the drive shaft 86*b*1. The configuration of the second screw, which corresponds to the second conveyance member, includes the driven shaft 87*b*1 and the driving force receiving portion 87*a* that receives a driving force from the drive transmission portion 86*a*. The driving force receiving portion 87*a* includes engaged portions 87*a*1 to 87*a*5 configured to receive a driving force by being engaged with the engaging portions 86*a*1 to 86*a*5 in the interior of the waste toner flow channel, which corresponds to the developer conveying path.

Here, in FIG. 1, a circle passing through distal ends of the engaging portions 87*a*1 to 87*a*5 about an axial line 86*b* of the first screw 86 is defined as an addendum circle 86*j*, and a circle passing through roots of the engaging portions 86*a*1 to 86*a*5 about an axial line 86*b* of the first screw 86 is defined as a root circle 86*k*. In an area outside of the root circle 86*k* and inside of the addendum circle 86*j*, portions where the engaging portions 86*a*1 to 86*a*5 do not exist correspond to communicating portions 86*q* where the toner can pass through.

An outer diameter portion (distal end) 86*g*1 of the helical blade 86*g*, which corresponds to the developer conveying portion, is arranged outside of the root circle 86*k* and inside of the addendum circle 86*j*. In other words, the distal end of the developer conveying portion is arranged between the root circle 86*k* and the addendum circle 86*j*.

Accordingly, the waste toner conveyed by the helical blade 86*g* can pass through the communicating portions 86*q* in the axial direction of the first screw 86, and thus the waste toner conveyance performance is improved without increasing a diameter of the helical blade 86*g*.

In order to increase the width of the communicating portions 86*q*, the numbers of the engaging portions and the engaged portions can be reduced to numbers between 1 and 10.

Figure 16:
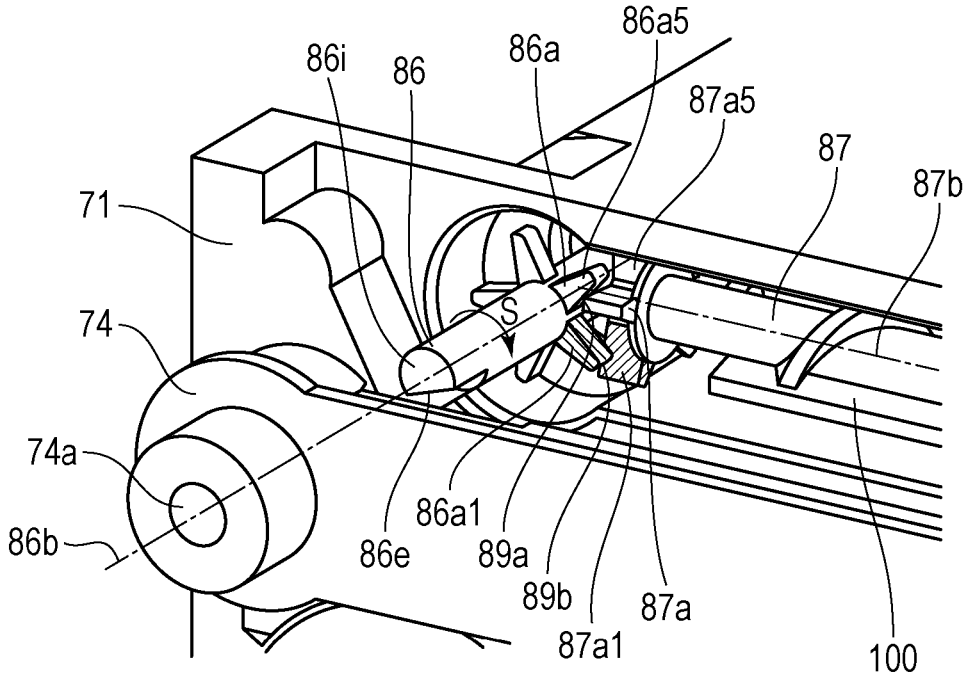
FIG. 16 is a perspective view of the drive coupling portion between the first screw and the second screw in Example 1 illustrating a state after certain time has elapsed from a state in FIG. 15.

The coupling portion between the first screw 86 and the second screw 87 will be described now in detail with reference to FIG. 1, FIG. 15, and FIG. 16. FIG. 1 is a drawing illustrating the coupling portion between the first screw 86 and the second screw 87 when viewing in an axial direction (hereinafter, referred to as a first axial line) 86*b* of the first screw (drive shaft) 86. FIG. 16 illustrates a state in which a certain time has elapsed from the state illustrated in FIG. 15. In FIG. 15 and FIG. 16, the engaging blade 86*a*1, which corresponds to an engaging portion and the engaged blade 87*a*1, which corresponds to an engaged portion located at a position where the driving force is transmitted, are hatched in order to facilitate the understanding of the operations thereof.

As illustrated in FIG. 15, the engaging blade 86*a*1 and the engaged blade 87*a*1 start to come into contact with each other by a rotation of the first screw 86 in a direction indicated by an arrow S. A position where the contact starts is referred to as a contact start position 89*a*.

As illustrated in FIG. 16, the first screw 86 and the second screw 87 rotate in the direction indicated by an arrow S in a state in which the engaging blade 86*a*1 and the engaged blade 87*a*1 are in contact with each other, and then the engaging blade 86*a*1 and the engaged blade 87*a*1 separate from each other. This separation position is referred to as a contact termination position 89*b*. At the same time as the separation, the next engaging blade 86*a*5 and the engaged blade 87*a*5 start to come into contact with each other at the contact start position 89*a*. With the repetition of such an operation (engagement), the rotational driving force of the first screw 86 is transmitted to the second screw 87.

At this time, a circle 86*d* formed by a trajectory drawn by the rotation of distal ends 86*c*1 to 86*c*5 of the engaging blades of the first screw 86 and an axial line 87*b* of the second screw (driven shaft) 87 (hereinafter, referred to as a second axial line) illustrated in FIG. 1 intersect each other. Accordingly, the first screw 86 and the second screw 87 do not have to be arranged in an overlapped manner, and may be arranged at the same position as illustrated in FIG. 1. Therefore, since the thickness in the vertical direction of FIG. 1 can be reduced, a space for arrangement of the first screw 86 and the second screw 87 may be reduced.

In addition, with the drive transmission performed within the waste toner flow channel 100, the engaging blades 86*a*1 to 86*a*5, which correspond to the engaging portions, and the engaged blades 87*a*1 to 87*a*5, which correspond to the engaged portions, contribute to an improvement in a waste toner conveyance performance. In Example 1, the blade shape is employed. However, the shape of the engaging portion is not particularly limited to the blade shape, and a bevel gear is also applicable. However, in the case of the bevel gear, the toner tends to jam between projecting portions and depressed portions, and insufficient drive transmission may result. Therefore, the engaging portions having the blade shape can be used.

The reduction in the size of the space in the height direction by an arrangement of the circle formed by the trajectory drawn by the rotation of the distal ends of the engaging blades and the axial line of the second screw so as to intersect each other has been described above. A cross section of the drive shaft 86 and an axial line of the driven shaft of the second screw can be arranged to intersect each other when viewing in an axial direction of the drive shaft 86. In this arrangement, the engaged portions are capable of receiving a larger driving force from the engaging portions projecting from the drive shaft.

Referring now to FIG. 15, an end portion of the drive shaft of the first screw 86 provided with the D-cut surface 86*e* is referred to as one end portion 86*i*, and an end portion opposite to the one end portion is referred to as the other end portion (not illustrated). In this case, the drive transmission portion 86*a* is arranged at a position closer to the one end portion 86*i* than to the other end portion of the first screw 86.

A force that twists the first screw 86 is applied to the D-cut surface 86*e* and the drive transmission portion 86*a*. Therefore, the D-cut surface 86*e* and the drive transmission portion 86*a* can be provided at positions close to each other. In Example 1, the drive transmission portion 86*a* is provided on the drive side of the D-cut surface 86*e*. In this configuration, a torsional deformation between the D-cut surface 86*e* and the drive transmission portion 86*a* may be reduced. In this configuration, the torsional deformation of the first screw 86 may be reduced, and thus a drive transmission from the first screw 86 to the second screw 87 can be performed stably.

In Example 1, in FIG. 1, an axial line 87*b* of the driven shaft 87 extends in the horizontal direction. However, the axial line 87*b* may be inclined as illustrated in FIG. 23.

A slope of the axial line 87*b* in this configuration with respect to the horizontal direction is defined as β. An angle of an inclined surface along which the waste toner can slide down under its own weight is defined as an angle of repose.

Figure 23:
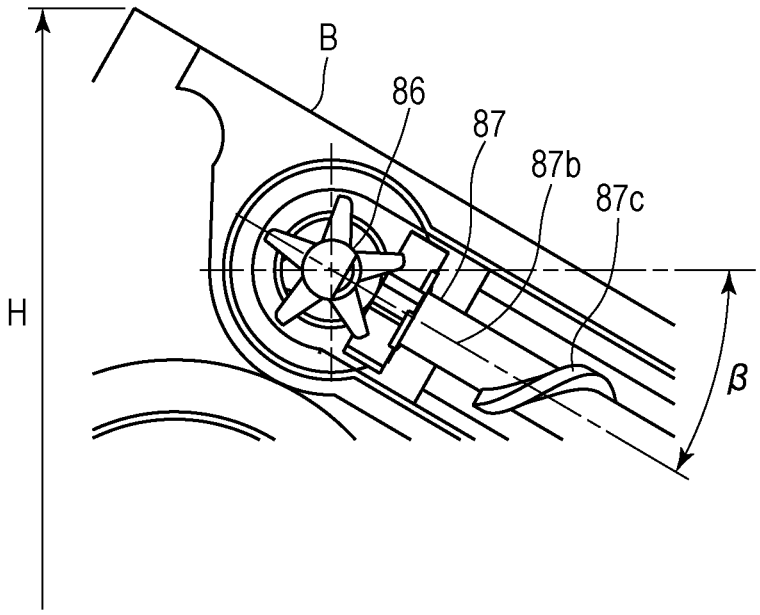
FIG. 23 is a drawing illustrating a state in which the second screw in Example 1 is inclined with respect to a horizontal direction.

In the case where the angle of slope β of the driven shaft 87*b*1 with respect to the horizontal direction is directed downward (a direction of gravitational force) as illustrated in FIG. 23 the waste toner can be conveyed by an operation of a helical blade 87*c* of the second screw 87 in this configuration even though the slope β is not larger than the angle of repose.

However, in the case where the slope β is directed upward, if the slope β is larger than the angle of repose, the conveyed waste toner flows reversely toward the drive shaft under its own weight instead of flowing toward the waste toner chamber. Consequently, the waste toner conveyance performance is lowered. Therefore, the upward angle β can be set to the angle of repose or smaller.

As described above, in this configuration, the waste toner can be conveyed even though the slope β is set to an angle not larger than the angle of repose. Accordingly, a height H of the conveying device illustrated in FIG. 23 may be reduced.

Although it depends on the type of the toner, the angle of repose of the toner is on the order of 65° in many cases. However, when considering the reduction of the height H of the conveying device, the slope β can be as small as 0±10° (slope is within a range from 0 to 10°).

As described thus far, according to Example 1, a reduction of the space for the arrangement of the first screw 86 and the second screw 87 is achieved. Accordingly, a reduction in the size of the conveying device is achieved correspondingly. In accordance with the reduction in the size of the conveying device, a reduction in sizes of the developing device, the cleaning device, and the image forming apparatus is also achieved.

The functions, materials, shapes, and relative arrangement of the components described in Example 1 are not intended to limit the scope of the invention unless otherwise specifically described. The invention is not particularly limited to the process cartridge, and may be applied to any conveying devices which convey a developer.

Example 2

A mode of Example 2 of the invention will now be described below.

In Example 2, different parts from Example 1 (such as a drive transmission portion and a developer conveying portion) will be described in detail. The materials and the shapes are the same as those in Example 1 unless otherwise specifically described again. Those parts are denoted by the same reference numerals, and a detailed description will be omitted.

The arrangement, positioning, and a method of drive coupling of the first screw 86, which corresponds to a first conveyance member, and the second screw 87, which corresponds to a second conveyance member, are the same as those in Example 1.

The first conveyance member is provided with a drive shaft 86*b*1 including an axial line and the drive transmission portion 86*a* configured to transmit a driving force. The developer conveying portion 86*g* configured to convey toner is also provided. The drive transmission portion includes an engaging portion that projects from the drive shaft. In the same manner, the second conveyance member includes a driven shaft having an axial line, and the driving force receiving portion configured to receive the driving force. A developer conveying portion configured to convey the toner is also provided. The driving force receiving portion includes an engaged portion configured to receive the driving force by being engaged with the engaging portion of the first conveyance member in the interior of a developer conveying path.

Figure 17:
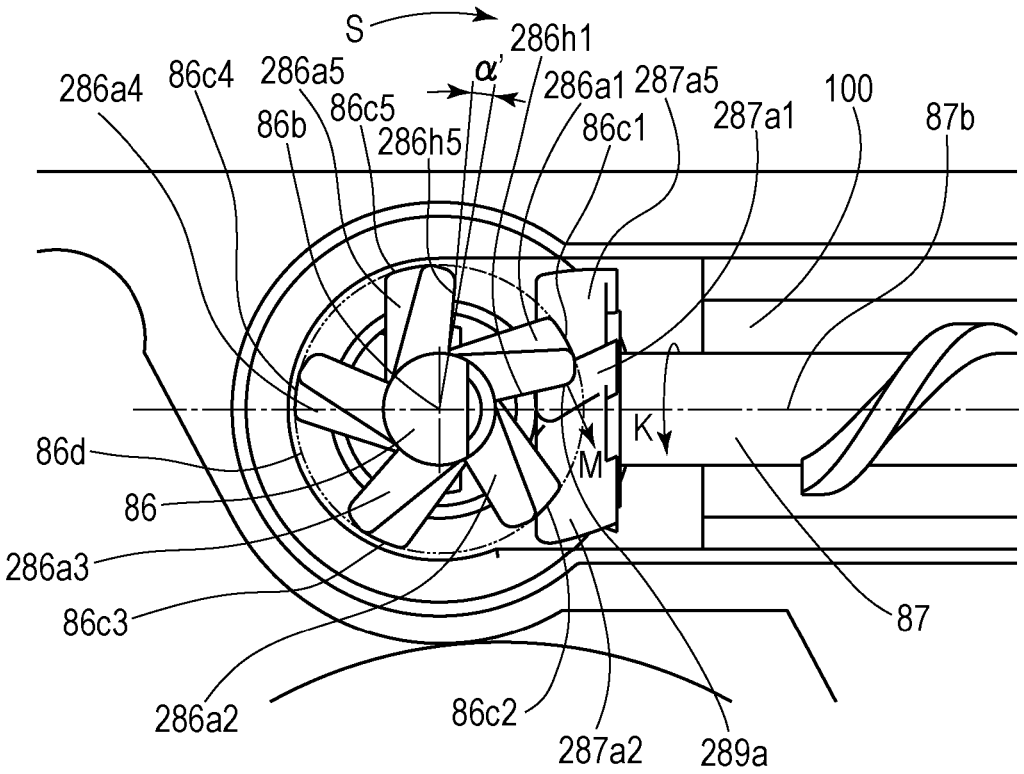
FIG. 17 is a drawing illustrating a drive coupling portion between a first screw and a second screw in Example 2 viewing in an axial direction of the first screw.
Figure 18:
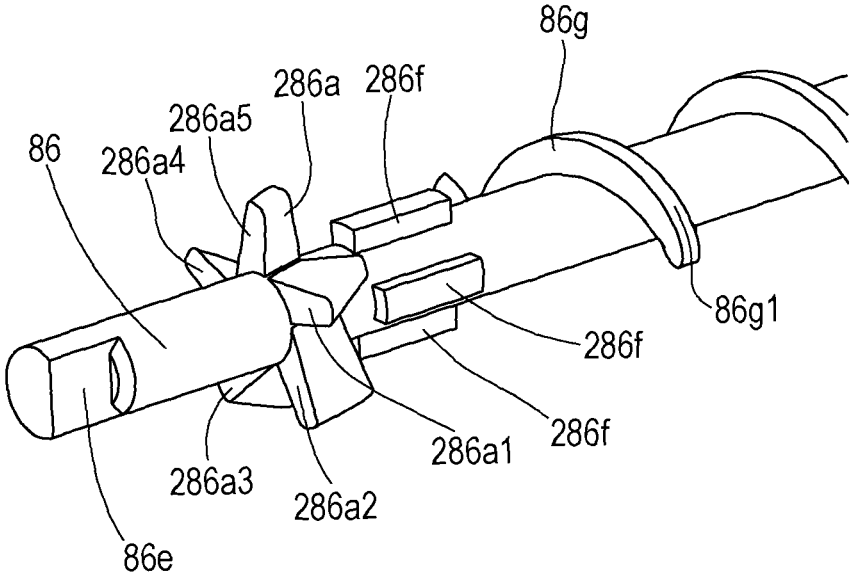
FIG. 18 is a perspective view of a portion in the vicinity of a drive transmission portion of the first screw in Example 2.
Figure 19:
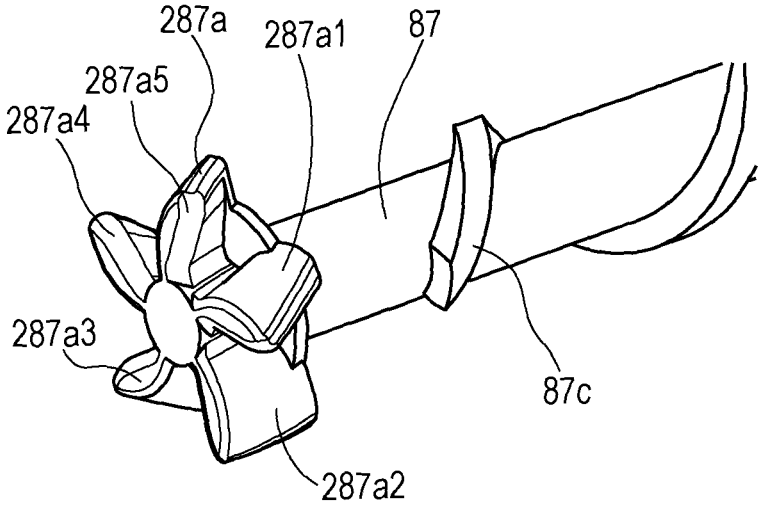
FIG. 19 is a perspective view of a portion in the vicinity of a driving force receiving portion of the second screw in Example 2.

The shapes of the first screw 86 and the second screw 87 will be described with reference to FIG. 17, FIG. 18, and FIG. 19. FIG. 17 is a drawing illustrating a drive coupling portion between the first screw 86 and the second screw 87 in Example 2 viewing in a direction of the first axial line 86*b*. FIG. 18 is a perspective view of a portion in the vicinity of a drive transmission portion 286*a* of the first screw 86. FIG. 19 is a perspective view of a portion in the vicinity of a driving force receiving portion 287*a* of the second screw 87.

The shape of the first screw 86 will be described.

The first screw 86 includes the helical blade 86*g* as a developer conveying portion. Accordingly, the waste toner is conveyed in a direction indicated by an arrow X (toward the drive transmission portion). At this time, engaging blades 286*a*1 to 286*a*5 are twisted in a direction opposite to the direction of the helical blade 86*g* (FIG. 18).

Accordingly, the waste toner conveyed by the helical blade 86*g* in the direction indicated by the arrow X and the waste toner conveyed by the engaging blades 286*a*1 to 286*a*5 hit against each other in the direction of the first axial line 86*b*. In the vicinity of the drive transmission portion 286*a*, the waste toner is pushed out in a radial direction of the first screw 86. Therefore, the waste toner conveyance performance in a direction indicated by an arrow Y is improved, and accumulation of the waste toner in an area where a developer is delivered is prevented. By providing a delivery accelerating area 100*a* configured to facilitate delivery of the developer upstream in the conveyance direction of the waste toner with a helical blade of the first screw at a position adjacent to an end portion of the second screw that engages the first screw, efficient conveyance of the developer is achieved.

In addition, since the drive transmission portion 286*a* is provided downstream of the second screw 87 in the direction indicated by the arrow X, hitting of the waste toner each other occurs in the vicinity of the second screw 87. Therefore, the waste toner conveyance performance in the direction indicated by the arrow Y is improved in the vicinity of the second screw 87.

In the vicinity of the drive transmission portion 286*a*, paddle-shaped members 286*f* (FIG. 18) projecting from the first screw 86 in the radial direction are provided as the developer conveying portions to improve the waste toner conveyance performance in the direction indicated by the arrow Y. In order to achieve the conveyance of the toner efficiently, the paddles of Example 2 include the delivery accelerating area 100*a* in the direction Y.

The shape of the second screw 87 will now be described.

The second screw 87 includes a helical blade 87*c* as the developer conveying portion. Accordingly, the waste toner is conveyed in the direction indicated by the arrow Y (a direction opposite to the driving force receiving portion). Engaged blades 287*a*1 to 287*a*5 are twisted in the same direction as that of the helical blade 87*c* (FIG. 19). The engaged blades 287*a*1 to 287*a*5 improve the waste toner conveyance performance for conveying the waste toner in the direction indicated by the arrow Y by the rotation of the second screw 87.

The shape of the first screw 86 will be described below with reference to FIG. 17 and FIG. 1.

As illustrated in FIG. 17, an angle α' formed between a transmitting surface 286*h*5 of the engaging blade 286*a*5 and a straight line passing through the first axial line 86*b* and the root of the transmitting surface 286*h*5 of the first screw 86 is smaller than an angle α formed in the same manner in a configuration illustrated in FIG. 1. The same applies to other engaging blades 286*a*1 to 286*a*4, and thus description will be omitted.

Accordingly, the direction of a transmitting surface 286*h*1 at a contact start position 289*a* can be brought closer to a direction vertical to a moving direction K of the engaged blade 287*a*1. At the contact start position 289*a* in FIG. 17, a direction M of a force that the engaged blades 287*a*1 to 287*a*5 receive from the engaging blades 286*a*1 to 286*a*5 can be brought closer to the moving direction K of the engaged blades 287*a*1 to 287*a*5 than to a direction N of the force in FIG. 1. Therefore, a loss of the drive transmission force may be reduced.

As described thus far, according to Example 2, the space for arrangement of the first screw 86 and the second screw 87 may be reduced, and the reduction in size of the cleaning frame 71 is achieved, and consequently, the reduction in the size of the main body A is also achieved. The waste toner conveyance performance is improved, and jamming of the waste toner in the waste toner flow channel 100 is prevented.

Example 3

A mode of Example 3 of the invention will be described below.

In Example 3, a portion (a drive transmission portion) different from Example 1 described above will be described in detail. The materials and the shapes are the same as those in Examples described above unless otherwise specifically described again. Those parts are denoted by the same reference numerals, and a detailed description will be omitted.

Figure 20:
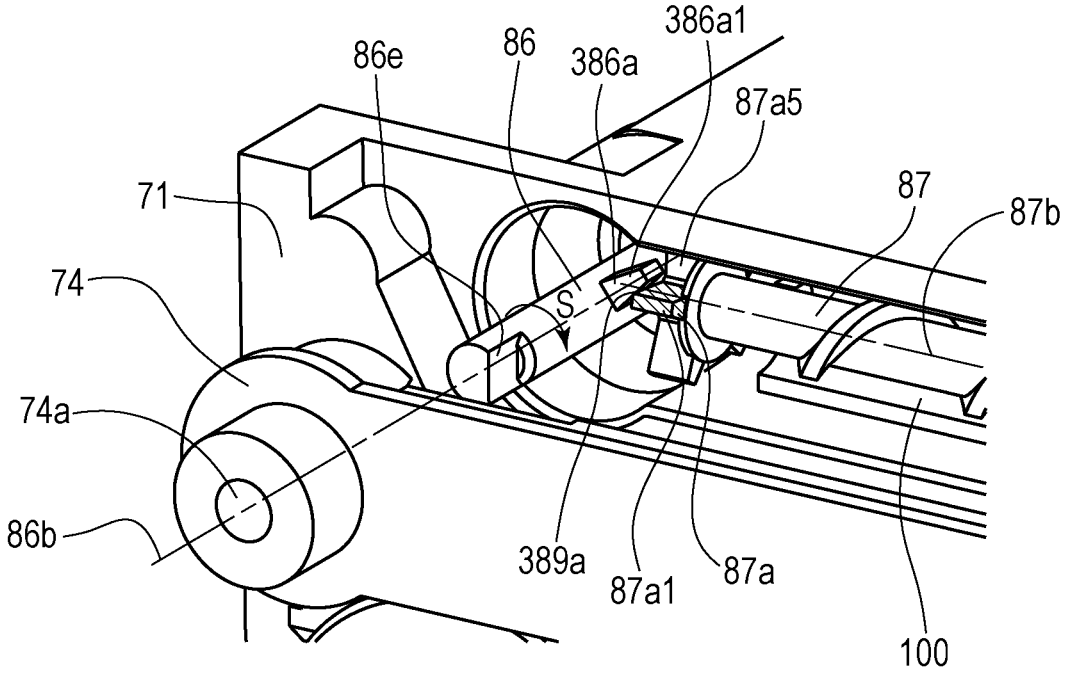
FIG. 20 is a perspective view of a drive coupling portion between a first screw and a second screw in Example 3.
Figure 21:
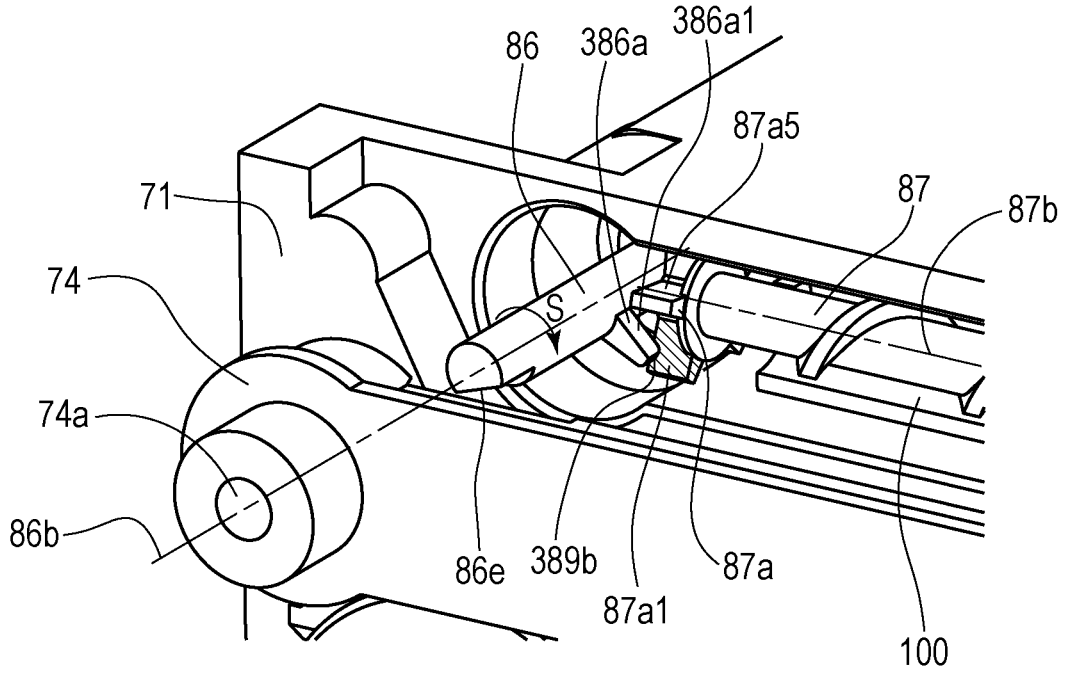
FIG. 21 is a perspective view of the drive coupling portion between the first screw and the second screw in Example 3 illustrating a state after certain time has elapsed from a state in FIG. 18.
Figure 22:
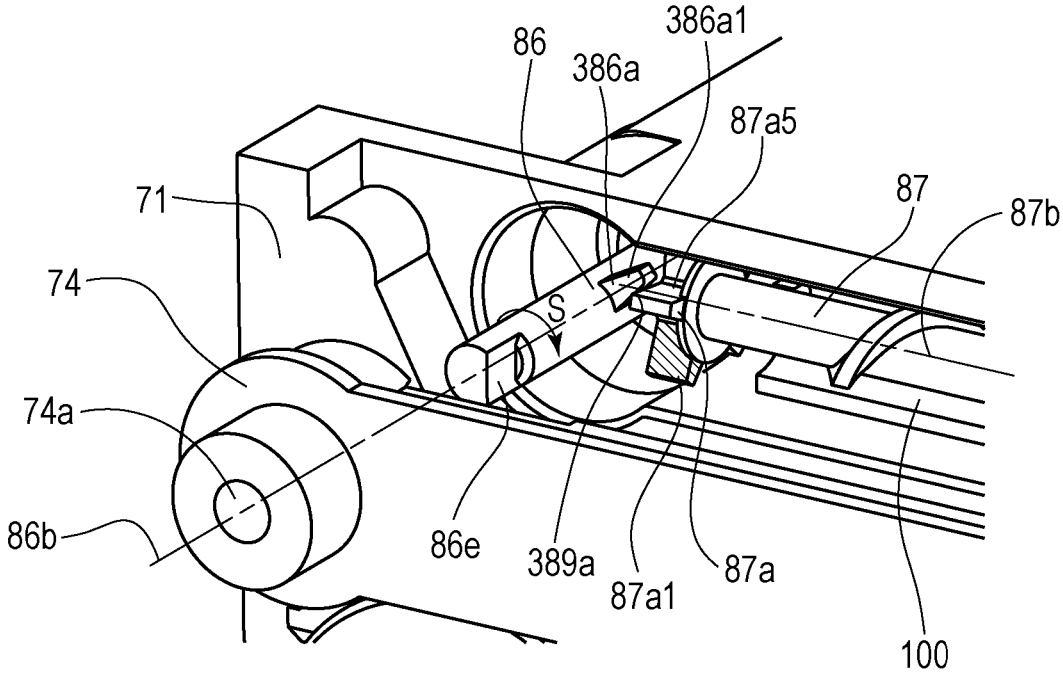
FIG. 22 is a perspective view of the drive coupling portion between the first screw and the second screw in Example 3 illustrating a state after certain time has elapsed from a state in FIG. 19.

A configuration of drive coupling in which a drive transmission portion 386*a* of the first screw 86 has only one engaging blade will be described in detail with reference to FIG. 20, FIG. 21, and FIG. 22. FIG. 20, FIG. 21, and FIG. 22 are perspective views of a drive coupling portion between the first screw 86 and the second screw 87 in Example 4. In order to facilitate the understanding of the description of the operation, the engaged blade 87*a*1 is hatched.

As described above, the drive transmission portion 386*a* of the first screw 86 includes only one engaging blade 386*a*1 as the engaging portion as illustrated in FIG. 20. The driving force receiving portion 87*a* of the second screw 87 includes five engaged blades 87*a*1 to 87*a*5.

When the first screw 86 rotates in the direction indicated by an arrow S, the engaging blade 386*a*1 and the engaged blade 87*a*1 start to come into contact with each other at a contact start position 389*a*.

As illustrated in FIG. 21, the first screw 86 and the second screw 87 rotate in the direction indicated by the arrow S in a state in which the engaging blade 386*a*1 and the engaged blades 87*a*1 come into contact with each other, and then the engaging blade 386*a*1 and the engaged blade 87*a*1 separate from each other at a contact termination position 389*b*.

As illustrated in FIG. 22, after only the first screw 86 has rotated in the direction indicated by the arrow S, the engaging blade 386*a*1 and the next engaged blade 87*a*5 start to come into contact with each other at the contact start position 389*a*. With the repetition of this operation, the rotational driving force of the first screw 86 is transmitted to the second screw 87.

As described above, even though the first screw 86 has only one engaging blade 386*a*1, a driving force can be transmitted to the second screw 87. Accordingly, the number of rotation of the first screw 86 can be set to be smaller than the number of rotation of the second screw 87.

As described thus far, according to Example 3, a reduction in the space for arrangement of the first screw 86 and the second screw 87 is achieved, and thus a reduction in the size of the conveying device is also achieved. Consequently, a reduction in the size of the main body A is achieved.

Example 4

A mode of Example 4 of the invention will be described below.

In Example 4, a portion (a drive transmission portion) different from Example 1 described above will be described in detail. The materials and the shapes of parts in Example 4 are the same as those in Examples described above unless otherwise described anew. Those parts are denoted by the same reference numerals, and a detailed description will be omitted.

Figure 24:
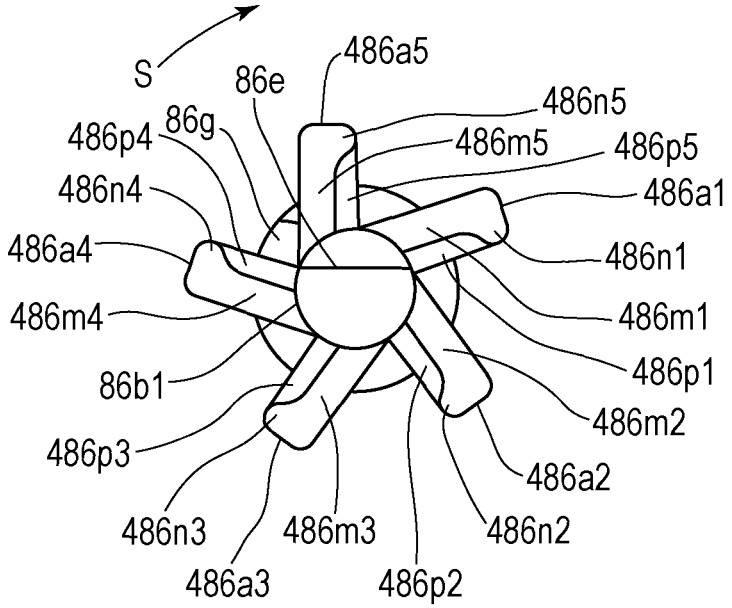
FIG. 24 is a drawing illustrating a drive transmission portion of a first screw in Example 4 viewing in an axial direction of the first screw.
Figure 25:
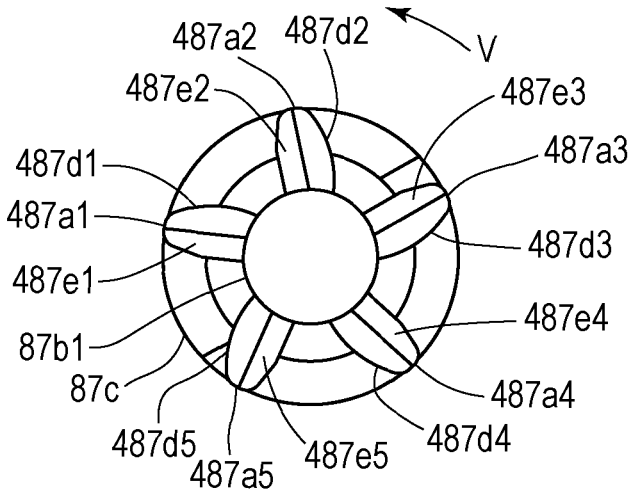
FIG. 25 is a drawing illustrating a driving force receiving portion of a second screw in Example 4 viewing in an axial direction of the second screw.
Figure 26:
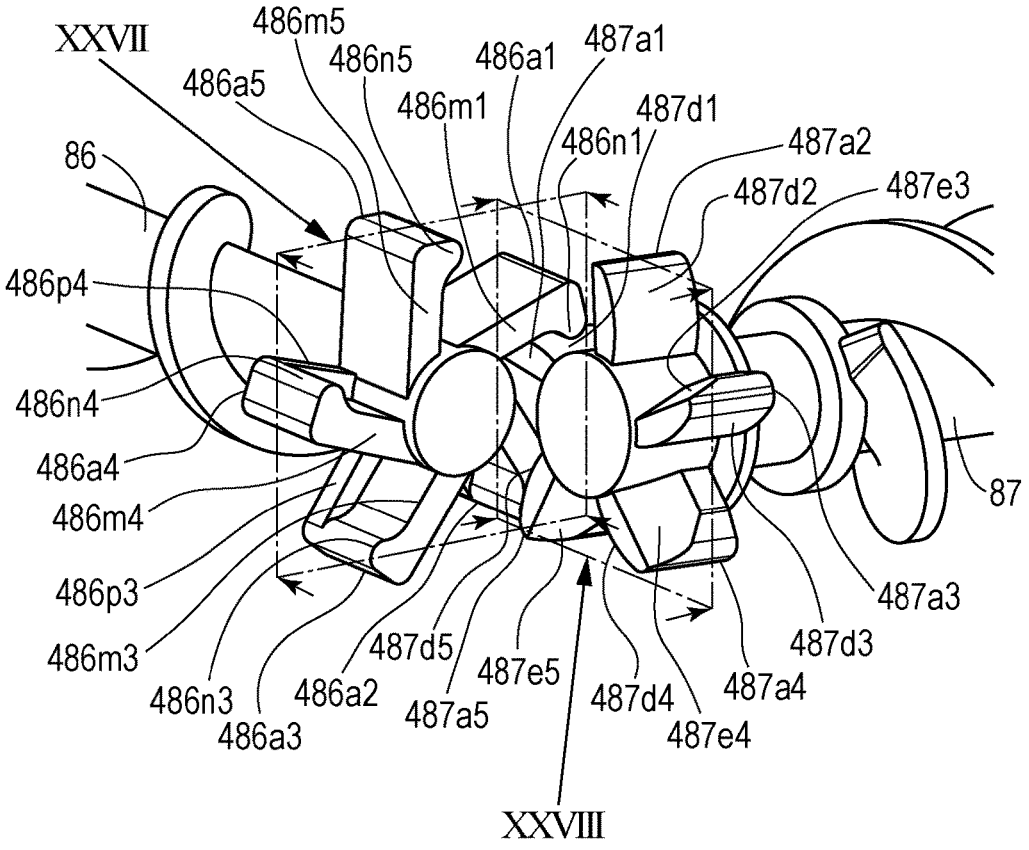
FIG. 26 is a perspective view of a drive coupling portion between the first screw and the second screw in Example 4.

FIG. 24 is a drawing illustrating a drive transmission portion 486*a* in Example 4 viewing in an axial direction 86*b* of the first screw 86. FIG. 25 is a drawing illustrating a driving force receiving portion 487*a* of Example 4 viewing in an axial direction 87*b* of the second screw 87. FIG. 26 is a perspective view of a drive coupling portion between the first screw 86 and the second screw 87 of Example 4.

The first screw 86 will be described with reference to FIG. 24. The first screw 86 rotates in a direction indicated by an arrow S. Engaging portions 486*a*1 to 486*a*5 of the drive transmission portion 486*a* include column portions 486*m*1 to 486*m*5 projecting from the drive shaft 86*b*1 in a radial direction, and contact portions 486*n*1 to 486*n*5 projecting downstream in the direction indicated by the arrow S from portions in the vicinity of distal ends of the column portion 486*m*1 to 486*m*5. The contact portions are also projecting portions.

The second screw 87 will now be described with reference to FIG. 25. The second screw 87 rotates in a direction indicated by an arrow V. Engaged portions 487*a*1 to 487*a*5 of the driving force receiving portion 487*a* include contacted surfaces 487*d*1 to 487*d*5 upstream in the direction of the arrow V. The contacted surfaces 487*d*1 to 487*d*5 each have a curved surface curving downstream in the direction indicated by the arrow V radially outward of the driven shaft 87*b*1.

As illustrated in FIG. 26, a driving force of the first screw 86 is transmitted to the second screw 87 by an engagement between the contact portions 486*n*1 to 486*n*5 and the contacted surfaces 487*d*1 to 487*d*5.

The engaging blades 486*a*1 to 486*a*5 are provided with reinforcing portions 486*p*1 to 486*p*5 configured to prevent a deformation and a breakage due to the drive transmission force, respectively. When viewing in the axial direction, the reinforcing portions have a larger width (in the rotational direction) than the column portions. In contrast, the reinforcing portions have the same width in the rotational direction as the contact portions projecting downstream in the direction indicated by the arrow S (the rotational direction). The reinforcing portion, the column portion, and the contact portion form a depressed portion. Therefore, when viewing straight ahead from the end portion toward a center portion of the screw in the axial direction, the reinforcing portions are seen beyond the column portion so as to continue therefrom. Such surfaces are seen in FIG. 24. The engaged portions 487*a*1 to 487*a*5 are provided downstream thereof in the rotational direction of the second screw 87 with undercut portions 487*e*1 to 487*e*5 for avoiding interference with the first screw 86.

Figure 27:
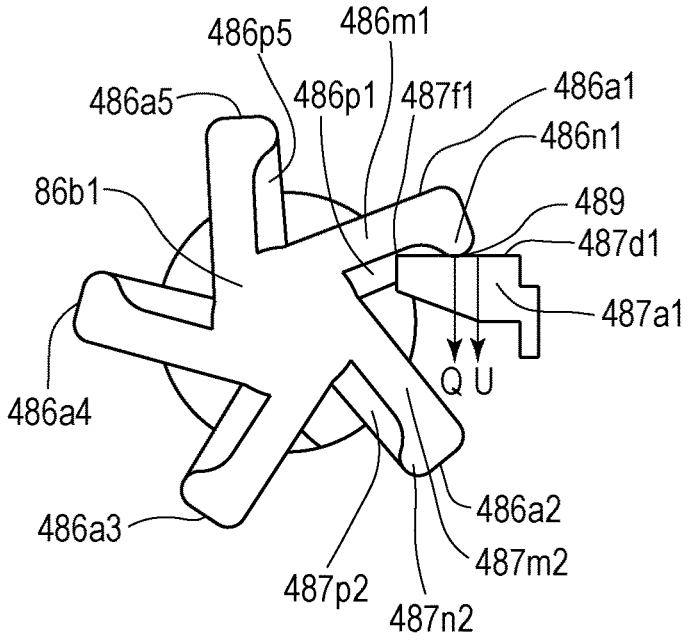
FIG. 27 is a cross-sectional view of the drive coupling portion between the first screw and the second screw in Example 4 taken along a plane XXVII-XXVII in FIG. 26.
Figure 28:
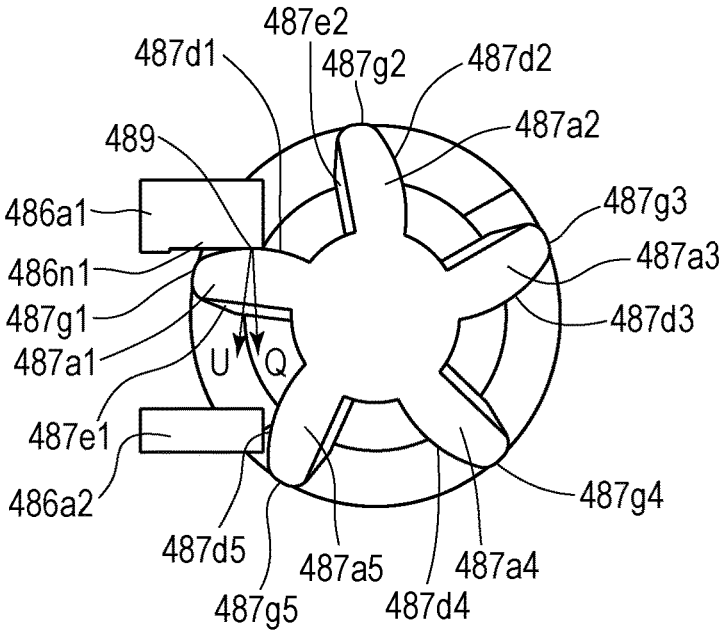
FIG. 28 is a cross-sectional view of the drive coupling portion between the first screw and the second screw in Example 4 taken along a plane XXVIII-XXVIII in FIG. 26.

FIG. 27 and FIG. 28 illustrate cross sectional views taken along a plane XXVII-XXVII and a plane XXVIII-XXVIII in FIG. 26, respectively. In each of these drawings, a force applied from the contact portions 486*n*1 to 486*n*5 to the contacted surfaces 487*d*1 to 487*d*5 when transmitting a driving force is indicated by an arrow Q and a moving direction of contacted surfaces 487*d*1 to 487*d*5 at a point of application of the force is indicated by an arrow U.

As illustrated in FIG. 27, the contact portions 486*n*1 to 486*n*5 project from the column portions 486*m*1 to 486*m*5, and thus the column portions 486*m*1 to 486*m*5 do not come into contact with axial end portions 487*f*1 to 487*f*5 of the contacted surfaces 487*d*1 to 487*d*5.

Accordingly, the arrow Q is always directed to the same direction as the arrow U when viewing in the axial direction of the first screw 86. In this manner, by matching the direction of the force at the contact point with the moving direction, a loss of the drive transmission force can be reduced.

As illustrated in FIG. 28, since the contacted surfaces 487*d*1 to 487*d*5 are formed into curved surfaces, the contact portions 486*n*1 to 486*n*5 do not come into contact with radially end portions 487*g*1 to 487*g*5 of the contacted surfaces 487*d*1 to 487*d*5. Accordingly, the arrow Q is always directed to a direction close to the direction of the arrow U when viewing in the axial direction of the second screw 87. In this manner, by setting the direction of the force and the moving direction at the contact point to directions close to each other, the loss of the drive transmission force can be reduced.

As described thus far, according to Example 4, a reduction in the space of arrangement of the first screw 86 and the second screw 87 is achieved, and thus a reduction in the size of the conveying device is also achieved.

In addition, the loss of the drive transmission force can be reduced when viewing in both axial directions of the first screw 86 and the second screw 87, and thus a reduction in energy required for driving the screws and an increase in lifetime of components are achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-242589, filed Nov. 28, 2014, and No. 2015-221356 filed Nov. 11, 2015, which are hereby incorporated by reference herein in their entirety.

What is claimed is:

1. A conveying device comprising:

a developer conveying path;

a first conveyance member for conveying a developer in the developer conveying path, the first conveyance member having a first shaft configured to be rotatable about a first axial line, a drive transmission portion configured to transmit a driving force, and a first developer biasing portion projecting from the first shaft and configured to convey the developer toward the drive transmission portion; and a second conveyance member for conveying the developer in the developer conveying path, the second conveyance member having a driving force receiving portion configured to receive the driving force from the drive transmission portion in the developer conveying path, a second shaft configured to be rotatable about a second axial line by the driving force received by the driving force receiving portion, and a second developer biasing portion projecting from the second shaft and configured to convey the developer conveyed by the first conveyance member, wherein the second developer biasing portion is a helical blade wound around the second shaft, wherein the driving force is transmitted by engagement of an engaging portion provided on the drive transmission portion with an engaged portion provided on the driving force receiving portion, and wherein a circle of a trajectory drawn by a distal end of the drive transmission portion and a line of extension of the second axial line overlap when viewed in a direction of the first axial line.

2. The conveying device according to claim 1, wherein the engaging portion has a shape of projecting in a radial direction of the first shaft, the engaged portion has a shape of projecting in a radial direction of the second shaft, and either more than one of the engaging portions or more than one of the engaged portions are provided.

3. The conveying device according to claim 1, wherein the direction of the first axial line and a direction of the second axial line are orthogonal to each other.

4. The conveying device according to claim 1, wherein the first conveyance member includes an input portion configured to receive a force for rotating the first conveyance member from an exterior at one end portion in the direction of the first axial line, and the drive transmission portion is arranged at a position closer to the one end portion than the other end portion in the direction of the first axial line.

5. The conveying device according to claim 4, wherein the engaging portion has a blade shape twisted in a direction opposite to a direction of twist of the blade shape of the first developer biasing portion.

6. The conveying device according to claim 1, wherein the first developer biasing portion has a blade shape.

7. The conveying device according to claim 6, wherein the engaging portion has a shape of projecting in a radial direction of the first shaft, wherein in the radial direction of the first shaft, a distal end of the first developer biasing portion is provided between an addendum circle that is a movement trajectory drawn by an outer end of the engaging portion and a root circle that is a movement trajectory drawn by an inner end of the engaging portion when viewed the direction of the first axial line, and wherein, the first conveyance member is provided with a communicating portion where the developer can pass through in the direction of the first axial line, the communicating portion being disposed in an area outside of the root circle and inside of the addendum circle when viewed in the direction of the first axial line.

8. The conveying device according to claim 7, wherein a plurality of the engaging portions are provided and the number of the engaging portions falls within a range from one to ten.

9. The conveying device according to claim 6, wherein the engaging portion is configured to convey the developer in a direction opposite to a direction in which the first developer biasing portion conveys the developer.

10. The conveying device according to claim 1, wherein the engaging portion includes a column portion projecting in a radial direction of the first shaft, and a contact portion projecting downstream in a rotational direction of the first shaft from the column portion, the engaged portion includes a contacted surface upstream in a rotational direction of the second shaft, the contacted surface is curved downstream in the rotational direction of the second shaft radially outward of the second shaft.

11. A cleaning device detachably attached to a main body of an image forming appratus, the cleaning device comprising:

a cleaning member configured to remove a developer on an image bearing member, and the conveying device according to claim 1 configured to convey the developer.

12. The cleaning device according to claim 11, wherein the first shaft is arranged so as to face the image bearing member, and the direction of the first axial line is parallel to a rotational axis direction of the image bearing member.

13. A developing device detachably attached to a main body of an image forming appratus, the developing device comprising:

a developer bearing member configured to bear a developer; and the conveying device according to claim 1 configured to convey the developer.

14. A process cartridge detachably attached to a main body of an image forming appratus, the process cartridge comprising:

an image bearing member configured to bear a developer image; and the conveying device according to claim 1.

15. An image forming apparatus comprising:

a main body; and the conveying device according to claim 1, wherein the conveying device is detachably attached to the main body.

16. The conveying device according to claim 1, wherein the second shaft is extended toward a direction crossing to the first shaft.

17. The conveying device according to claim 1, wherein the second conveyance member is configured to convey the developer in a state in which an angle of the second axial line with respect to a horizontal direction is smaller than an angle of repose of the developer.

* * * * *